US008100755B2

(12) United States Patent
Enzminger

(10) Patent No.: US 8,100,755 B2
(45) Date of Patent: Jan. 24, 2012

(54) METHOD, APPARATUS, AND PROGRAM PRODUCT FOR DISTRIBUTING RANDOM NUMBER GENERATION ON A GAMING NETWORK

(75) Inventor: Joseph R. Enzminger, Austin, TX (US)

(73) Assignee: Multimedia Games, Inc., Austin, TX (US)

( * ) Notice: Subject to any disclaimer, the term of this patent is extended or adjusted under 35 U.S.C. 154(b) by 362 days.

(21) Appl. No.: 12/463,462

(22) Filed: May 11, 2009

(65) Prior Publication Data

US 2010/0285865 A1 Nov. 11, 2010

(51) Int. Cl.
*A63F 9/24* (2006.01)

(52) U.S. Cl. ..... 463/22

(58) Field of Classification Search ..... 463/15–26
See application file for complete search history.

(56) References Cited

U.S. PATENT DOCUMENTS

| | | | | |
|---|---|---|---|---|
| 3,548,174 | A * | 12/1970 | Knuth | 708/250 |
| 4,652,998 | A * | 3/1987 | Koza et al. | 463/26 |
| 5,327,365 | A | 7/1994 | Fujisaki et al. | |
| 5,772,509 | A | 6/1998 | Weiss | |
| 5,779,545 | A | 7/1998 | Berg et al. | |
| 6,264,557 | B1 | 7/2001 | Schneier et al. | |
| 6,389,439 | B1 | 5/2002 | Mitsunaga et al. | |
| 6,477,251 | B1 | 11/2002 | Szrek et al. | |
| 6,709,331 | B2 | 3/2004 | Berman | |
| 6,743,102 | B1 | 6/2004 | Fiechter et al. | |
| 6,790,143 | B2 | 9/2004 | Crumby | |
| 7,617,292 | B2 * | 11/2009 | Moore et al. | 709/216 |
| 2002/0002076 | A1 * | 1/2002 | Schneier et al. | 463/29 |
| 2002/0004785 | A1 * | 1/2002 | Schull | 705/51 |
| 2002/0025845 | A1 * | 2/2002 | Cannon | 463/16 |
| 2002/0111214 | A1 * | 8/2002 | Lind et al. | 463/42 |
| 2003/0054879 | A1 * | 3/2003 | Schneier et al. | 463/29 |

(Continued)

FOREIGN PATENT DOCUMENTS

CH 685793 A5 9/1995

(Continued)

OTHER PUBLICATIONS

Mascagni et al., "SPRNG: A Scalable Library for Pseudorandom Number Generation," ACM Transactions on Mathematical Software, Sep. 1, 2000, 13 pages.

*Primary Examiner* — Ha Tran T Nguyen
*Assistant Examiner* — Vongsavanh Sengdara
(74) *Attorney, Agent, or Firm* — Nathan H. Calvert; The Culbertson Group, P.C.

(57) ABSTRACT

Methods, apparatus, and program products are disclosed for providing distributed RNG calculation capability. Generally, gaming machines cooperate on a gaming network to calculate a result for a RNG algorithm. A preferred system uses peer machines to perform partial RNG calculations, but server machines may also be used. One method calculates a first partial RNG calculation at a first peer machine using a seed value. The first peer machine transmits results of the first partial calculation to a second peer machine, which completes the RNG calculation. Some algorithms may include a step of combining partial results from two or more gaming machines. A preferred system uses a RNG state tracker and a seed tracker operating on a RNG master machine. This machine initializes a partial RNG with a seed value, and then tracks the state of the partial RNG using results from the completed calculation obtained over the network.

21 Claims, 16 Drawing Sheets

U.S. PATENT DOCUMENTS

2003/0104859 A1* 6/2003 Chaum ..... 463/22
2003/0104865 A1* 6/2003 Itkis et al. ..... 463/39
2003/0130029 A1* 7/2003 Crumby ..... 463/20
2003/0130032 A1* 7/2003 Martinek et al. ..... 463/29
2003/0157979 A1* 8/2003 Cannon et al. ..... 463/16
2004/0019844 A1* 1/2004 Goodnow et al. ..... 714/798
2004/0054807 A1* 3/2004 Harvey et al. ..... 709/243
2004/0102235 A1* 5/2004 Berman ..... 463/16
2004/0147308 A1* 7/2004 Walker et al. ..... 463/25
2004/0166923 A1* 8/2004 Michaelson et al. ..... 463/20
2004/0204235 A1* 10/2004 Walker et al. ..... 463/29
2004/0229698 A1* 11/2004 Lind et al. ..... 463/42
2005/0037834 A1* 2/2005 Stern et al. ..... 463/20
2005/0059469 A1* 3/2005 Gail et al. ..... 463/19
2005/0102516 A1* 5/2005 Oishi ..... 713/168
2005/0267991 A1* 12/2005 Huitema et al. ..... 709/245
2005/0267993 A1* 12/2005 Huitema et al. ..... 709/245
2006/0020648 A1* 1/2006 Merati et al. ..... 708/250
2006/0142079 A1* 6/2006 Ikehara et al. ..... 463/27
2007/0060316 A1* 3/2007 O'Halloran ..... 463/25
2007/0105611 A1* 5/2007 O'Halloran ..... 463/16
2007/0168789 A1* 7/2007 Udell ..... 714/724
2007/0207852 A1* 9/2007 Nelson et al. ..... 463/24
2008/0216076 A1* 9/2008 Udell et al. ..... 718/100
2009/0060180 A1* 3/2009 Schneider ..... 380/46
2009/0227354 A1* 9/2009 Johnson ..... 463/20
2009/0300363 A1* 12/2009 Hamalainen et al. ..... 713/178

FOREIGN PATENT DOCUMENTS

WO WO 2004/036414 A2 4/2004

* cited by examiner

Fig. 16A

| Req. Machine | Sending Machine | Game ID | Record ID | RNG ID | RNG Stage | Value | Timestamp |
|---|---|---|---|---|---|---|---|
| | | | | | | | |

Fig. 16B

| RNG ID | Previous Xn | Prev. Record ID | State Info | Timestamp |
|---|---|---|---|---|
| | | | | |

METHOD, APPARATUS, AND PROGRAM PRODUCT FOR DISTRIBUTING RANDOM NUMBER GENERATION ON A GAMING NETWORK

TECHNICAL FIELD OF THE INVENTION

This invention relates to random number generation for networked gaming machines, and particularly to use of RNG algorithms distributed among more than one networked machine.

BACKGROUND OF THE INVENTION

In the gaming industry, random numbers are commonly used to produce outcomes for slot machine games. Typically, the generated numbers are used as bingo or keno numbers, used to determine a stop position for a "virtual reel," or used to look up (index) an outcome from a table of outcomes defined for a particular game or game round. Random numbers may also be used to select displays to convey to the player an existing outcome.

The term "random numbers" may refer to true-random numbers (measured from random phenomena), or pseudo-random numbers, which are generated with algorithms to appear unpredictable and have statistically random distributions like true random numbers. Pseudo-random number generators (PRNGs) are algorithms that produce sequences of pseudo-random numbers with good random properties. But typical PRNGs will eventually repeat their sequence if they run for a long time, so they are not random by the strictest definition. Nevertheless, common usage in the gaming industry and programming industry is to simply refer to such pseudo-random numbers as random.

One of the most common PRNGs is the linear congruential generator, which uses a previously-generated value of the algorithm to generate a new random number according to the following equation:

$$X_{n+1}=(aX_n+c)\bmod m \tag{1}$$

Where $X_{n+1}$ is the resulting random number, $X_n$ is the previous output of the algorithm (with n=0 designating the seed to start the sequence of pseudo-random numbers), and $a$, $c$, and $m$ are carefully chosen constant integers. This algorithm has been criticized because it fails some of the popular tests used to characterize a RNG as "random enough." However, it is considered sufficiently fair for use in many gaming applications, and variations of the algorithm are used in many gaming jurisdictions.

Other PRNG algorithms are also known in the art, such as the "Mersenne twister" algorithm, various linear-feedback-shift-register (LFSR) algorithms, and the lagged-Fibonacci algorithm, to name a few examples. Other popular PRNG algorithms involve combining multiple known algorithms to improve the random properties of the output number stream.

Most computer programming languages include functions or routines for pseudo-random number generation. Where random qualities or security are important, programmers also develop their own implementation of a PRNG. Such routines often provide a pseudo-random number formatted as a digital byte, or a floating point number uniformly distributed between 0 and some chosen number. The numbers can be scaled using a multiplier or distribution function so that they are in the range needed for application in, for example, a slot machine prize table index. PRNG algorithms for use in slot machines are carefully tested and regulated by the relevant governing gaming commissions. Often certain algorithms or implementations are disallowed for fairness or security reasons.

Some slot machines have a PRNG algorithm running as a computer process inside the slot machine, while others request a random number from a central server that runs one or more PRNG algorithms. For simplicity, the term RNG as used in the description shall include PRNG, as is generally used in the gaming industry.

Gaming jurisdictions often place limitations not only on what kind of RNG can be used, but also on which machines are allowed to run the RNG. What is needed, therefore, are secure and fair RNG algorithms that meet legal requirements in the relevant jurisdictions, and can provide suitable random numbers for modern slot machine games.

SUMMARY OF THE INVENTION

Methods, apparatus, and program products are disclosed for providing distributed RNG calculation capability. Generally, machines cooperate on a gaming network to calculate a result for a RNG algorithm. A preferred system uses peer machines to perform partial RNG calculations, but server machines may also be used.

One method herein calculates a first partial RNG calculation at a first peer machine using a seed value. The first peer machine transmits results of the first partial calculation to a second peer machine. The second peer machine finishes the RNG calculation, and results are provided to the requesting machine. Some algorithms may include a step of combining partial results from two or more machines.

A preferred system uses a RNG state tracker and a seed tracker operating on a RNG master machine. This master machine initializes a partial RNG with a seed value, and then tracks the state of the partial RNG using results from the completed calculation obtained over the network.

Various RNG algorithms may be distributed using the techniques taught herein. A linear congruential algorithm is shown divided among two networked machines. A CA-based algorithm is also shown distributed among multiple machines, with some CA cells being calculated on one machine, and other cells on another machine. Preferably, algorithms requiring a seed are distributed among multiple machines by performing first partial calculations using the seed (or state data such as the previous RNG output), and then transmitting intermediate results from the first partial calculations to another machine and performing second partial calculations using those results, thereby achieving distribution of the RNG calculations across multiple machines.

These and other advantages and features of the invention will be apparent from the following description of the preferred embodiments, considered along with the accompanying drawings.

BRIEF DESCRIPTION OF THE DRAWINGS

FIG. 16A is a diagram of a data structure for requesting distributed generation of a RNG according to one embodiment.

FIG. 16B is a diagram of a data structure for storing a partial RNG state according to one embodiment.

DESCRIPTION OF PREFERRED EMBODIMENTS

Figure 1:
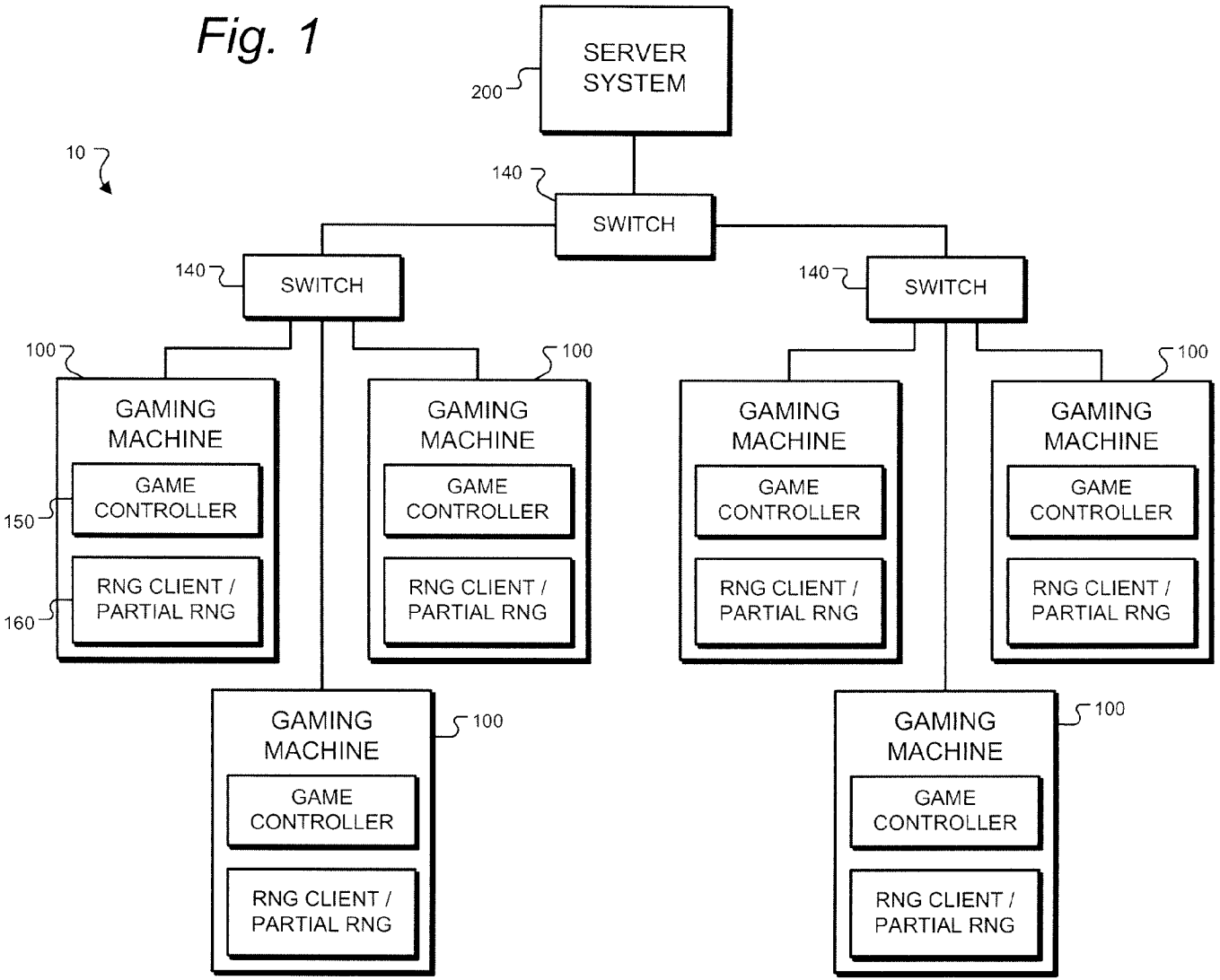
FIG. 1 is a system diagram of a networked gaming system according to one embodiment of the present invention.

FIG. 1 is a system diagram of a networked gaming system 10 according to one embodiment of the present invention. System 10 generally includes multiple gaming machines 100 present on a network including switches 140 and a server system 200, which may include multiple servers. The depicted gaming machines 100 are preferably slot-style gaming machines which present various wagering games. The games have outcomes determined by a RNG, a bingo game, or a predetermined ticket record, for example. Each gaming machine 100 includes a gaming controller 150 for operating and presenting games to the player. The controller has various sub-modules not relevant to the present disclosure. Also included in each gaming machine 100 is a RNG (random number generator) client and partial RNG module 160. These modules enable machines 100 to obtain RNGs using pseudo-RNG (PRNG) algorithms distributed in various ways among machines 100 in system 10.

Figure 2:
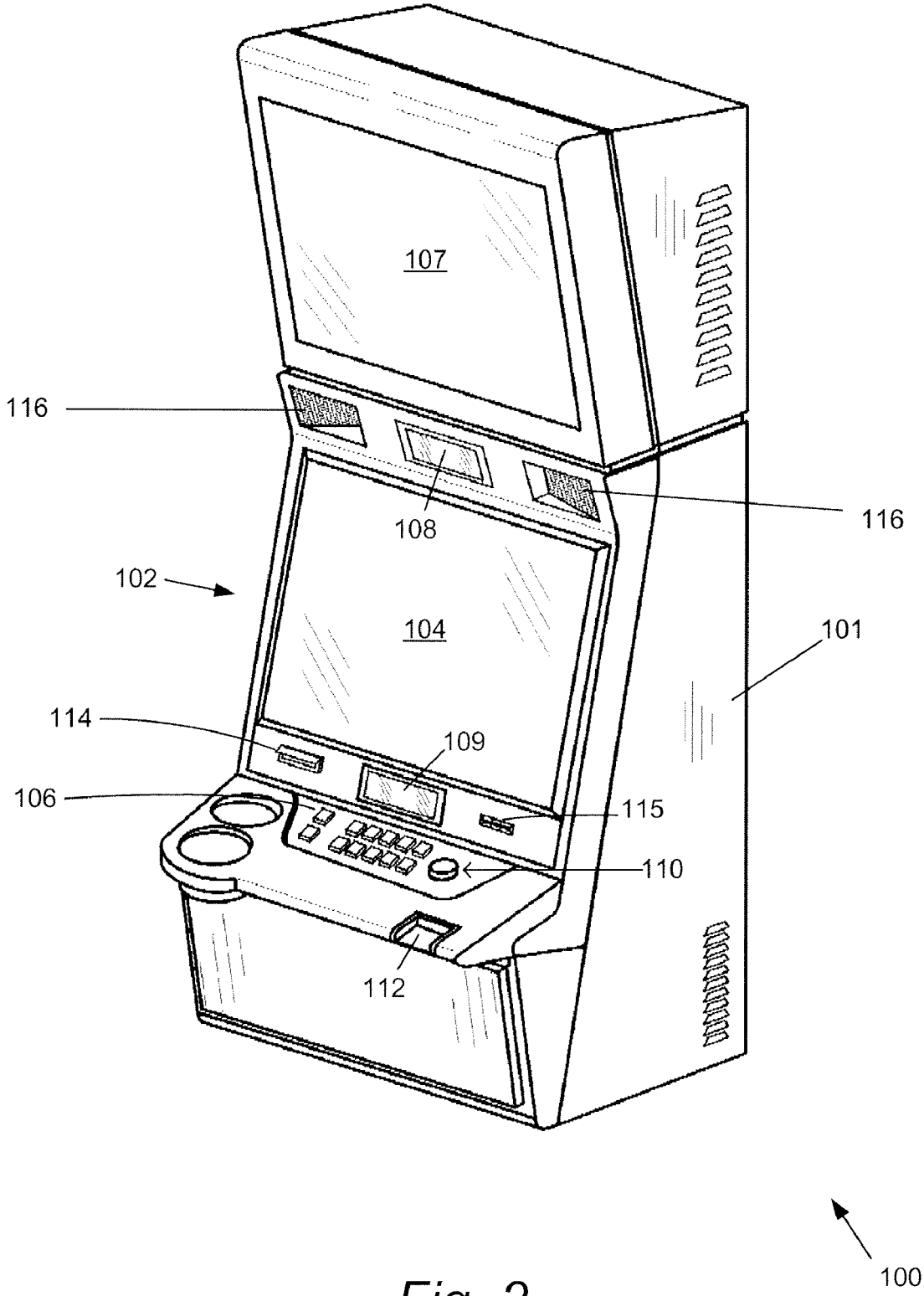
FIG. 2 is a front perspective view of a gaming machine which may be used in a gaming system embodying the principles of the present invention.
Figure 3:
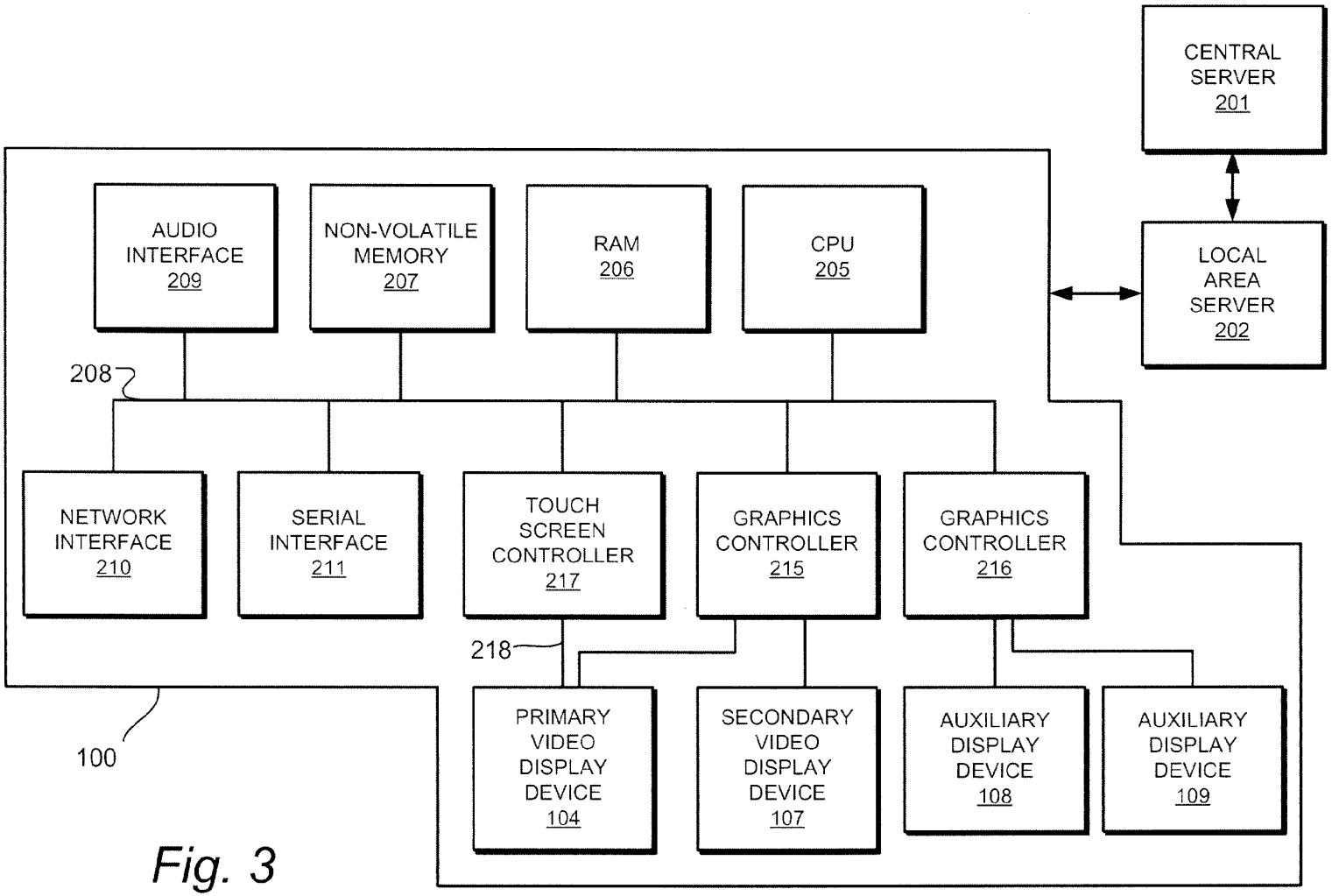
FIG. 3 is a diagrammatic representation showing various electronic components of the gaming machine shown in FIG. 1 together with additional gaming system components.

FIG. 2 shows a gaming machine 100 that may be used to implement a variable prize progression game according to the present invention. The block diagram of FIG. 3 shows further details of gaming machine 100 connected in a gaming system in which the present invention may be used to present gaming results to players.

Referring to FIG. 2, gaming machine 100 includes a cabinet 101 having a front side generally shown at reference numeral 102. A primary video display device 104 is mounted in a central portion of front surface 102, with a ledge 106 positioned below the primary video display device and projecting forwardly from the plane of the primary video display device. In addition to primary video display device 104, the illustrated gaming machine 100 includes a secondary video display device 107 positioned above the primary video display device. Gaming machine 100 also includes two additional smaller auxiliary display devices, an upper auxiliary display device 108 and a lower auxiliary display device 109. It should also be noted that each display device referenced herein may include any suitable display device including a cathode ray tube, liquid crystal display, plasma display, LED display, or any other type of display device currently known or that may be developed in the future.

Gaming machine 100 illustrated in FIG. 2, also includes a number of mechanical control buttons 110 mounted on ledge 106. These control buttons 110 may allow a player to select a bet level, select pay lines, select a type of game or game feature, and actually start a play in a primary game. Other forms of gaming machines according to the invention may include switches, joysticks, or other mechanical input devices, and/or virtual buttons and other controls implemented on a suitable touch screen video display. For example, primary video display device 104 in gaming machine 100 provides a convenient display device for implementing touch screen controls.

It will be appreciated that gaming machines may also include a number of other player interface devices in addition to devices that are considered player controls for use in playing a particular game. Gaming machine 100 also includes a currency/voucher acceptor having an input ramp 112, a player card reader having a player card input 114, and a voucher/receipt printer having a voucher/receipt output 115. Audio speakers 116 generate an audio output to enhance the user's playing experience. Numerous other types of devices may be included in gaming machines that may be used according to the present invention.

FIG. 3 provides a block diagram showing various electronic components of gaming machine 100 together with gaming system components external to the gaming machine. In particular, FIG. 3 shows gaming machine 100 connected for communication with local area server 202 and central server 201. Local area server 202 and central server 201, or both servers, may cooperate to identify results that are provided to gaming machine 100 in response to a game play entered (initiated) at the gaming machine. That is, local area server 202 and/or central server 201, or more particularly, one or more processing devices associated with local area server 202 and/or central server 201 may serve as a result controller for identifying game results achieved for a particular play in a game. Even where gaming machine 100 implements a result controller to identify a result for a game play initiated at the gaming machine, local area server 202 and/or central server 201 may be used to provide player tracking and accounting services for gaming machine 100 and other gaming machines included in the gaming system. It should be understood, however, that some forms of gaming machines that implement variable prize progression games according to the present invention may be entirely stand-alone gaming machines that do not communicate with any other devices.

FIG. 3 shows that gaming machine 100 includes a central processing unit (CPU) 205 along with random access memory (RAM) 206 and nonvolatile memory or storage device 207. All of these devices are connected on a system bus 208 with an audio interface device 209, a network interface 210, and a serial interface 211. A graphics processor 215 is also connected on bus 208 and is connected to drive primary video display device 104 and secondary video display device 107 (both mounted on cabinet 101 as shown in FIG. 2). A second graphics processor 216 is also connected on bus 208 in this example to drive auxiliary display devices 108 and 109 also shown in FIG. 2. As shown in FIG. 3, gaming machine 100 also includes a touch screen controller 217 connected to system bus 208. Touch screen controller 217 is also connected via signal path 218 to receive signals from a touch screen element associated with primary video display device 104. It will be appreciated that the touch screen element itself comprises a thin film that is secured over the display surface of primary video display device 104. The touch screen element itself is not illustrated or referenced separately in the figures.

Those familiar with data processing devices and systems will appreciate that other basic electronic components will be included in gaming machine 100 such as a power supply, cooling systems for the various system components, audio amplifiers, and other devices that are common in gaming machines. These additional devices are omitted from the drawings so as not to obscure the present invention in unnecessary detail.

All of the elements 205, 206, 207, 208, 209, 210, and 211 shown in FIG. 3 are elements commonly associated with a personal computer. These elements are preferably mounted on a standard personal computer chassis and housed in a standard personal computer housing which is itself mounted in cabinet 101 shown in FIG. 2. Alternatively, the various electronic components may be mounted on one or more circuit boards housed within cabinet 101 without a separate enclosure such as those found in personal computers. Those familiar with data processing systems and the various data processing elements shown in FIG. 3 will appreciate that many variations on this illustrated structure may be used within the scope of the present invention. For example, since serial communications are commonly employed to communicate with a touch screen controller such as touch screen controller 217, the touch screen controller may not be connected on system bus 208, but instead include a serial communications line to serial interface 211, which may be a USB controller or a IEEE 1394 controller for example. It will also be appreciated that some of the devices shown in FIG. 3 as being connected directly on system bus 208 may in fact communicate with the other system components through a suitable expansion bus. Audio interface 209, for example, may be connected to the system via a PCI bus. System bus 208 is shown in FIG. 3 merely to indicate that the various components are connected in some fashion for communication with CPU 205 and is not intended to limit the invention to any particular bus architecture. Numerous other variations in the gaming machine internal structure and system may be used without departing from the principles of the present invention.

It will also be appreciated that graphics processors are also commonly a part of modern computer systems. Although separate graphics processor 215 is shown for controlling primary video display device 104 and secondary video display device 107, and graphics processor 216 is shown for controlling both auxiliary display devices 108 and 109, it will be appreciated that CPU 205 may control all of the display devices directly without any intermediate graphics processor. The invention is not limited to any particular arrangement of processing devices for controlling the video display devices included with gaming machine 100. Also, a gaming machine implementing the present invention is not limited to any particular number of video display device or other types of display devices, provided some display arrangement is included for displaying the prize progression graphic, the player selectable objects, and the display modifications resulting from the selection of the various player selectable objects.

In the illustrated gaming machine 100, CPU 205 executes software which ultimately controls the entire gaming machine including the receipt of player inputs and the presentation of the graphic symbols displayed according to the invention through the display devices 104, 107, 108, and 109 associated with the gaming machine. As will be discussed further below, CPU 205 either alone or in combination with graphics processor 215 may implement one or more controllers for performing functions associated with a variable prize wheel game according to the present invention. CPU 205 also executes software related to communications handled through network interface 210, and software related to various peripheral devices such as those connected to the system through audio interface 209, serial interface 211, and touch screen controller 217. CPU 205 may also execute software to perform accounting functions associated with game play. Random access memory 206 provides memory for use by CPU 205 in executing its various software programs while the nonvolatile memory or storage device 207 may comprise a hard drive or other mass storage device providing storage for programs not in use or for other data generated or used in the course of gaming machine operation. Network interface 210 provides an interface to other components of a gaming system such as the servers 202 and 201 in the illustrated embodiment.

It should be noted that the invention is not limited to gaming machines employing the personal computer-type arrangement of processing devices and interfaces shown in example gaming machine 100. Other gaming machines through which a variable prize wheel game is implemented may include one or more special purpose processing devices to perform the various processing steps for implementing the present invention. Unlike general purpose processing devices such as CPU 205, these special purpose processing devices may not employ operational program code to direct the various processing steps.

It should also be noted that the invention is not limited to gaming machines including only video display devices for conveying results. Some preferred forms of the invention utilize one or more video display devices for displaying the first game graphic display, then use a transition sequence from the first game graphic display to a second game graphic display, and then show the reel game graphic display. For example, a gaming machine such as that shown in FIG. 2 may use primary video display device 104 to display a primary/first game and then transition to a display suitable for showing a variable prize wheel and wheel spin game. As another example, a gaming machine suitable for providing a variable prize progression game may include a mechanical reel-type display rather than a video-type display device for displaying results in a primary game, and include a video display device for presenting the variable wheel game as a bonus game. Thus, a gaming machine suitable for use in the present invention may have a structure similar to that shown for gaming machine 100 in FIG. 2, but with a mechanical reel-type display replacing primary video display device 104.

Figure 4:
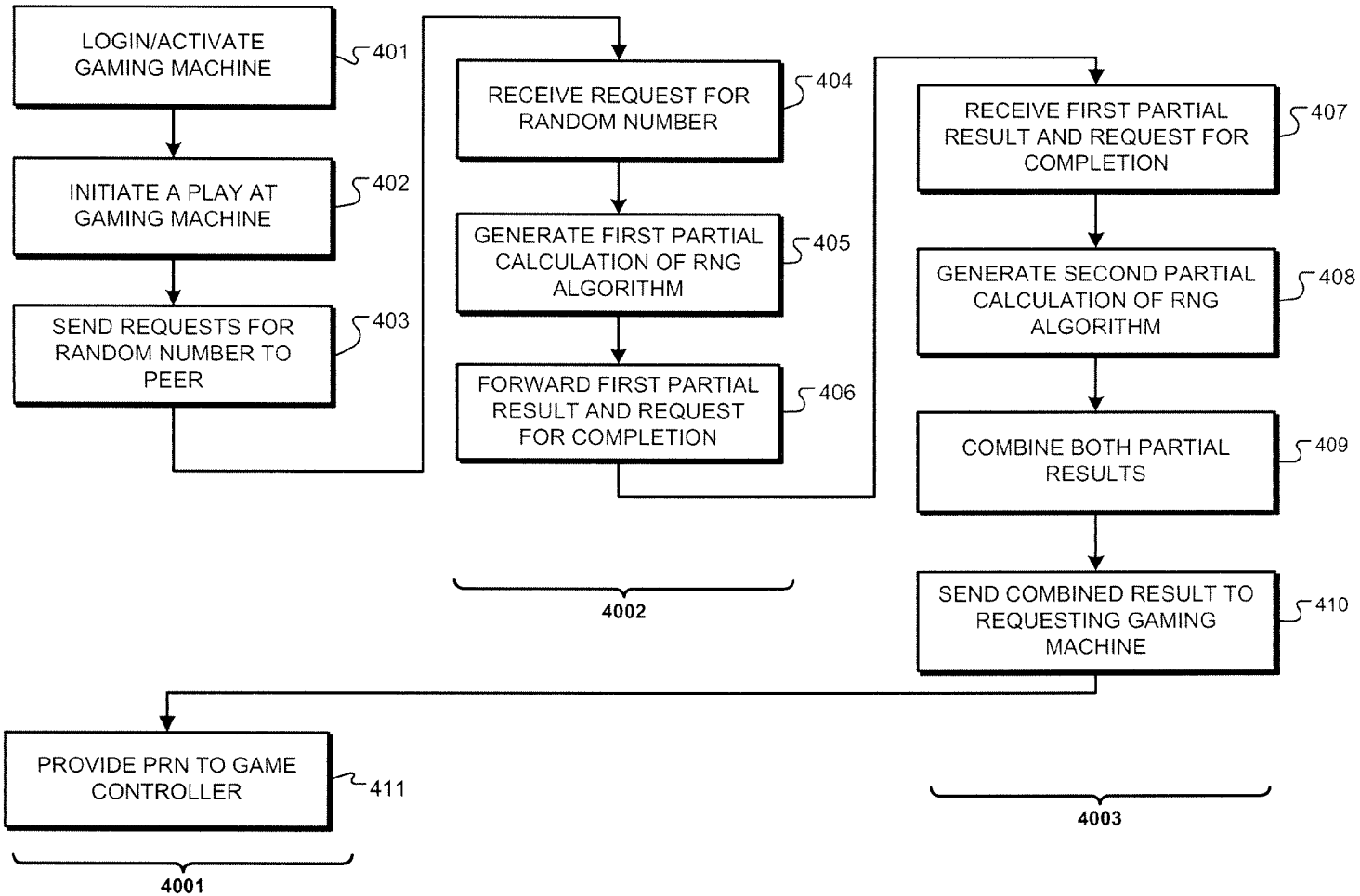
FIG. 4 is a flow chart of a distributed random number generation process according to one embodiment.

FIG. 4 is a flow chart of a distributed random number generation process according to one embodiment. The depicted process begins at step 401, where a user logs or otherwise activates a gaming machine. This may be done in any suitable manner, including using a player card or simply adding money or credits to the machine. At step 402, the player initiates a game play round at the machine, typically by activating a wager or play button. The gaming controller receives this activating input and begins to operate the game provided. During the game, the controller at some point requires a random number. The number may be needed to determine a game outcome or to determine a graphic display or sequence to use to convey a game outcome, or some other element in the game. In any event, to provide this number, the machine sends a request to a peer machine at step 403. Steps 401, 402, and 403 are grouped by bracket 4001 along with step 411 to indicate that all of these steps are performed at the game machine which uses the random number requested. This machine will be referred to as the requesting gaming machine, even though in some cases other machines send other types of requests in the various embodiments herein.

In step 404, the request sent in step 403 is received by another gaming machine on the network, referred to as a peer machine because both the requesting machine and this machine are peers to each other. All the process steps designed by bracket 4002 are performed at this peer machine. In response to receiving the request, the peer machine generates a first partial calculation of a RNG algorithm at step 405. Various examples of such calculation will be further described below, but in preferred embodiments this calculation does not produce a finished random number according to a complete PRNG algorithm; instead it only performs a portion of the calculations of a PRNG algorithm. The calculation is preferably performed by a partial RNG calculator software module running on the peer machine.

After the partial calculation of step 405, the peer machine forwards the partial calculation result along with a request to complete the calculation to another peer machine on the network (step 406). In this embodiment, the request from step 406 is received by a third machine, but some embodiments may use two machines total, as will be further described below. The depicted steps performed by the third machine are indicated by bracket 4003.

At step 407, the other peer machine receives the request and the result from the partial calculation for completion. The other peer machine generates a second partial calculation of the RNG algorithm using the partial result (step 408). The partial calculation is further described below.

In some embodiments, the partial calculations from both machines need to be combined in a separate step. This is shown at step 409. In other embodiments, the second partial calculation completes the algorithm and no separate combination or completion step is needed at step 409. Note that step 409 may be performed at another machine in various other embodiments. In step 410, the completed result (from either step 408 or 409) is sent to the requesting gaming machine. At that machine, the random number is provided to the game controller for use in the game (step 411).

While peer machines are described here as performing the partial calculations, various embodiments may also use a server to perform one or more partial calculations. Also note that the requesting machine may participate in the divided RNG calculation in some embodiments (it is also a peer machine).

Figure 5:
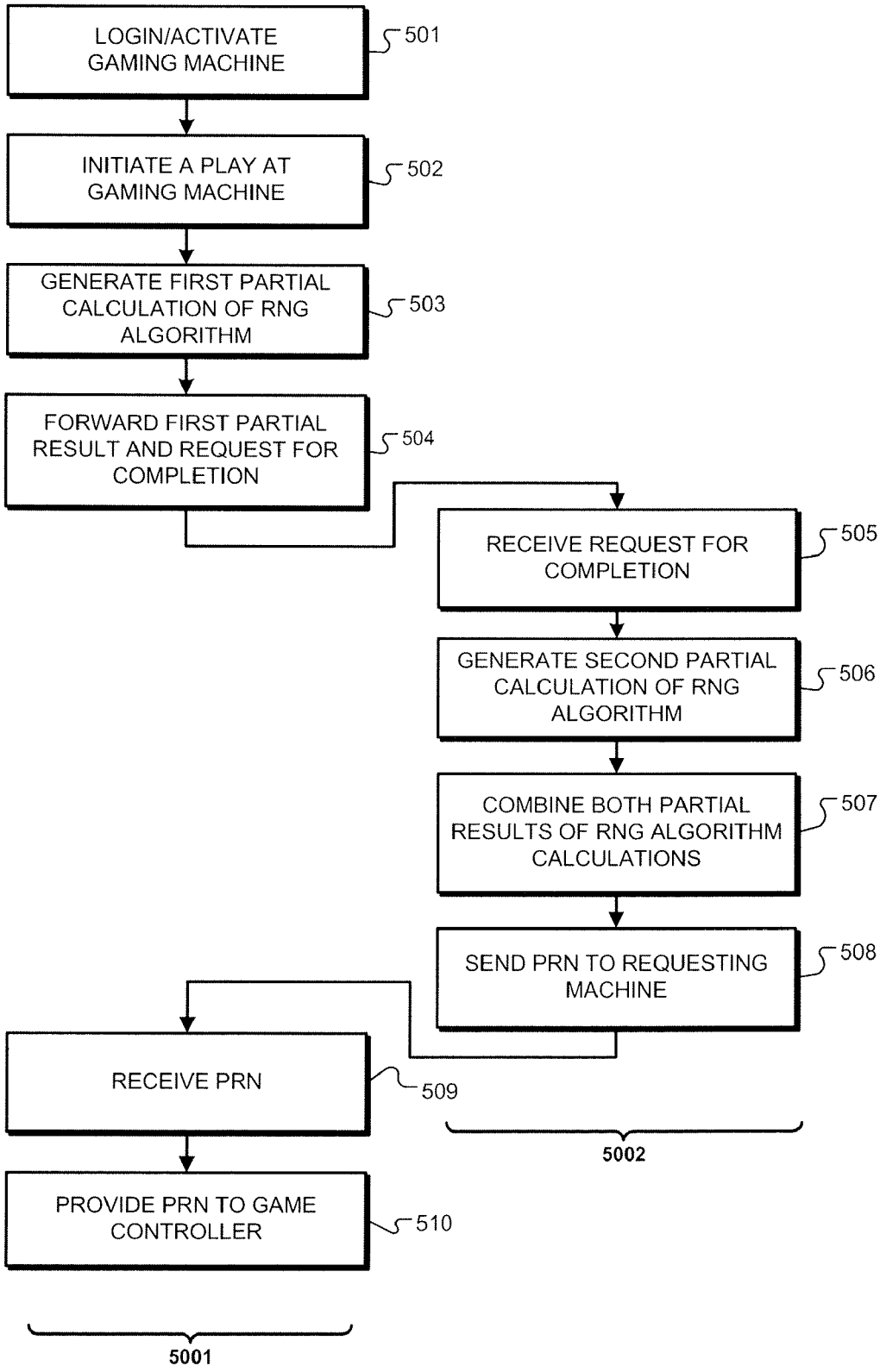
FIG. 5 is a flow chart of a distributed random number generation process according to another embodiment.

FIG. 5 is a flow chart of a distributed random number generation process according to another embodiment. In this embodiment, the requesting machine begins the RNG calculation process, and only one other machine is involved in the process. The depicted process begins at step 501, where a user logs or otherwise activates a gaming machine. At step 502, the player initiates a game play round at the machine, typically by activating a wager or play button. As previously described, the game controller needs at least one random number during the course of operating the game play round. To provide this number, the machine first generates a first partial calculation of a RNG algorithm at step 503. The machine sub-modules performing these steps will be further described below. The result of the partial calculation is sent to a peer machine, along with a request to complete the calculation, in step 504.

The peer machine receives the request for completion in step 505. All the steps performed at this peer machine are designated by bracket 5002, while all the steps performed at the requesting peer machine are designated by bracket 5001. In response to receiving the request, the peer machine generates a second partial calculation of the RNG algorithm at step 506. Various partial RNG algorithms are further described below. Note that while the depicted process shows the partial results of RNG algorithm calculations being combined at step 507, many embodiments will not involve a separate combination step. Also note that, while only one exchange of request and response is shown, various algorithms may be distributed into calculations requiring more than one exchange of data. For example, various shift register-type algorithms, or variations thereof such as the Mersenne twister algorithm, may involve passing data in both directions between the cooperating machines to simulate the various interconnections of shift register cells.

At step 508, the result of the completed calculation from step 507, a pseudo-random number (PRN) is sent to the requesting machine. Step 509 receives the PRN. Step 510 provides the result to the game controller for use in the game.

Figure 6:
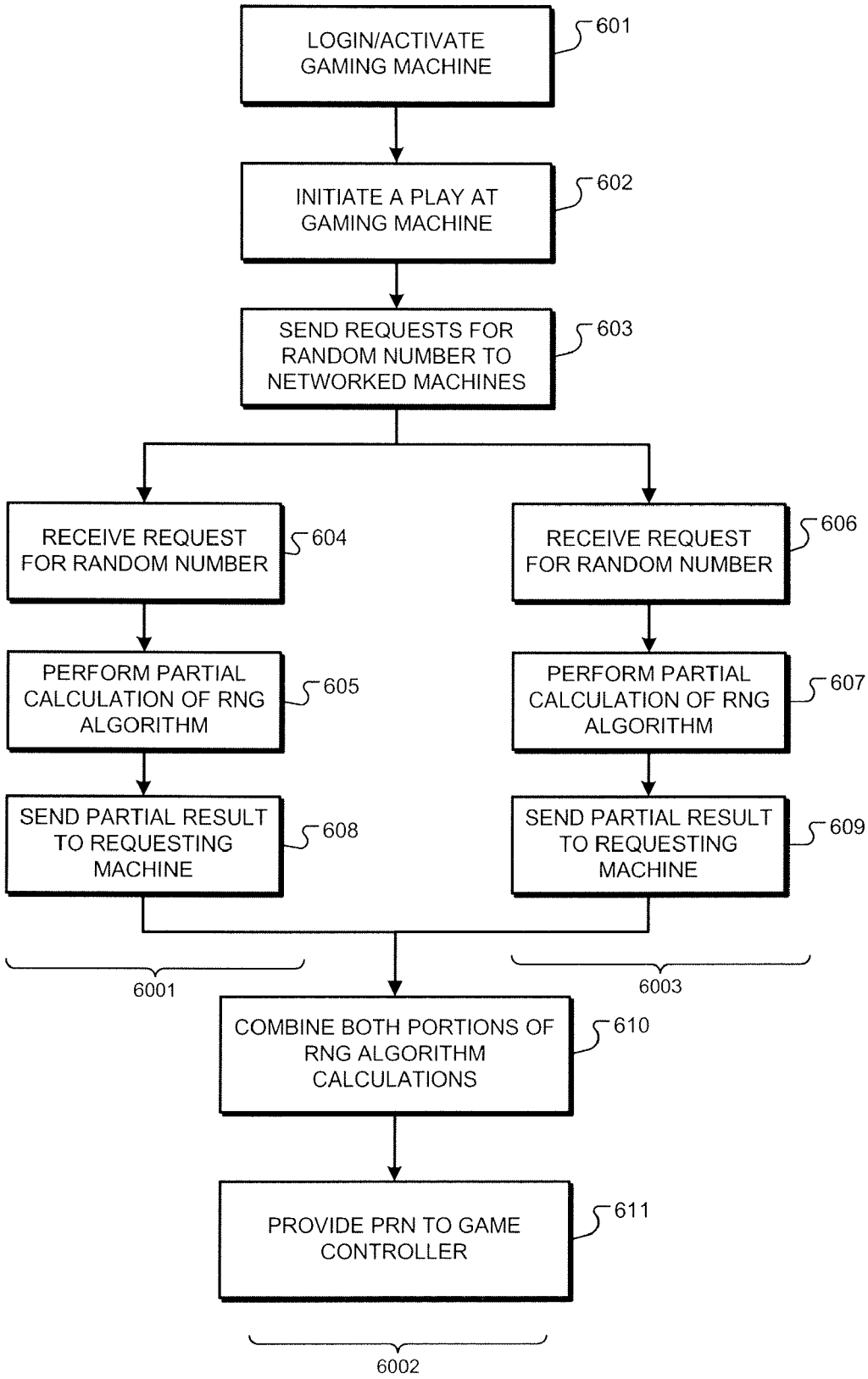
FIG. 6 is another flow chart of a distributed random number generation process according to another embodiment.

FIG. 6 is another flow chart of a distributed random number generation process according to another embodiment. In the depicted process, the requesting machine sends a request to two other machines and receives partial results back from both, combining the results to form a random number. The steps performed at the requesting machine are designated by bracket 6002, while the steps performed at the two peer machines are designated by brackets 6001 and 6003. The process begins at step 601, where a user logs or otherwise activates a gaming machine. At step 602, the player initiates a game play round at the gaming machine, typically by activating a wager or play button. When a random number is required in game play (which may happen once or multiple times in response to a single wager or game play input), the machine sends a request for a partial random number calculation at step 603 to two other machines (steps 604 and 606). The machines may be pre-configured to calculate a designated portion of a RNG algorithm, or the role of each machine may be determined by the requests. Each separate machine performs some partial calculation of a RNG algorithm at steps 605 and 607, preferably in parallel although simultaneous operation is not required (i.e., one machine may take longer or the requests may be transmitted one after the other). The result of the partial calculation is sent to the requesting machine at steps 608 and 609. The random number client at the requesting machine combines both portions of the received RNG algorithm calculations in step 610. Next, in step 611, the RNG client provides the PRN to the game controller.

The process shown in FIG. 6 may be useful, for example, when using algorithms such as the popular "mother" RNG algorithm which uses a combination of other RNG algorithms to improve the quality of the output when measured with a standardized series of tests. Note that in some embodiments such arrangement will not be preferred because complete working RNG algorithms are not allowed to run on a single machine. In other jurisdictions, such a solution is preferred because it improves the quality of the RNG stream.

Figure 7:
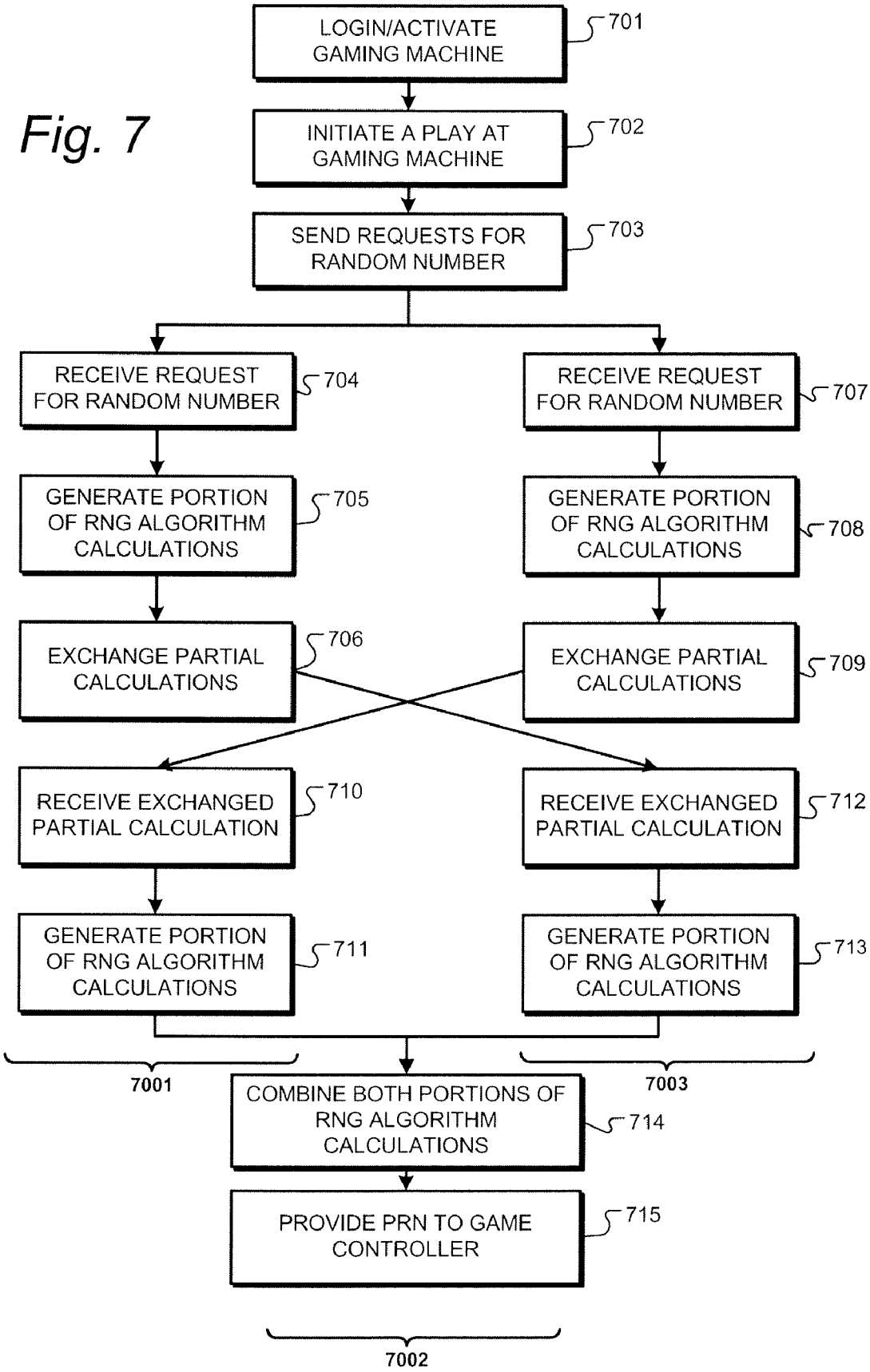
FIG. 7 is another flow chart of a distributed random number generation process according to yet another embodiment.

FIG. 7 is another flow chart of a distributed random number generation process according to yet another embodiment. The process shown in FIG. 7 is useful for versions of the invention that use linear feedback shift register RNG algorithms, or variations thereof that involve simulated shift registers. For example, various shift register type algorithms, or variations thereof such as the Mersenne twister algorithm, may involve passing data in both directions between the cooperating machines to simulate the various interconnections of shift register cells. In the depicted process, the requesting machine sends a request to two other machines which cooperate to perform portions of a RNG calculation. The steps performed at the requesting machine are designated by bracket 7002, while the steps performed at the two peer machines are designated by brackets 7001 and 7003.

The process begins at step 701, where a user logs in or otherwise activates a gaming machine. At step 702, the player initiates a game play round at the machine, typically by activating a wager or play button. When a random number is required in game play (which may happen once or multiple times in response to a single wager or game play input), the machine sends a request for a partial random number calculation to two other machines at step 703. The depicted process shows that requests are sent to two different machines at steps 704 and 707. However, the request may be sent to only one machine, which then initiates cooperation with the other machine. Each machine then generates a portion of the RNG algorithm calculations (steps 705 and 708). The two machines exchange the results of their partial calculations at steps 706 and 709. A variety of algorithms may require such an exchange between cooperating machines. For example in many linear feedback shift register type algorithms, a simulated shift register has cells that require input from other cells. The depicted exchange of data may in fact be the passing of a cell output from a portion of the shift register to a cell input in another portion of the shift register. Of course, PRNG algorithms may be split in a variety of functional ways, and this example is non-limiting. In steps 710 and 712, each cooperating machine receives a partial result from the other machine.

After receiving the partial result, each machine generates another portion of the RNG algorithm calculations, using data from the partial result. This is shown at steps 711 and 713. Next, the process combines both portions of the RNG algorithm calculations at step 714. In the depicted process, such combination takes place at the requesting machine, as designated by bracket 7002. Other versions may, of course, execute a combination step in either of the cooperating machines. After step 714, the process provides the generated PRN to the game controller for use in the game at step 715.

Figure 8:
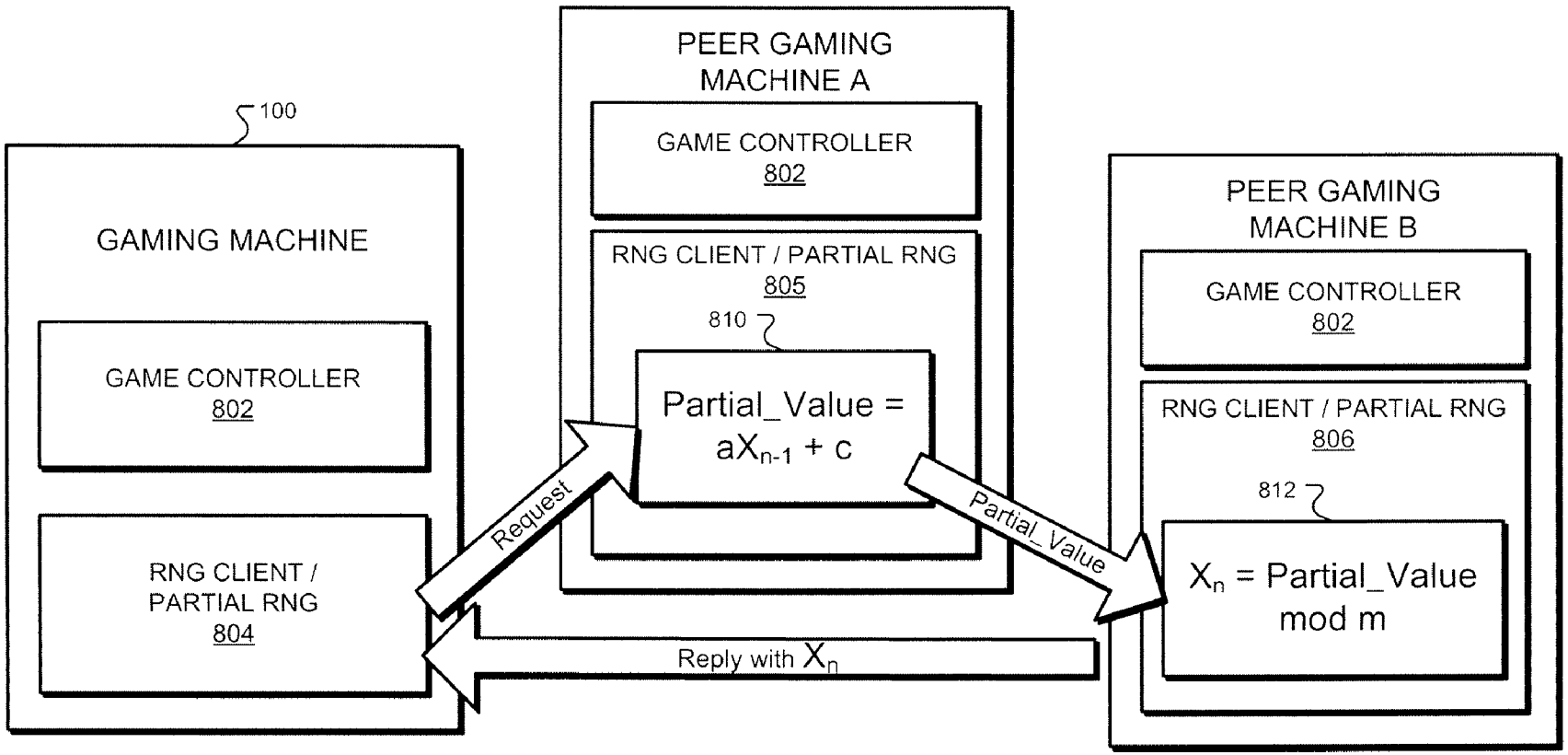
FIG. 8 is a block diagram of a distributed random number generation process using a linear congruential algorithm.

FIG. 8 is a block diagram of a distributed random number generation process using a linear congruential algorithm. The depicted block diagram shows partial calculations as they are performed by software modules on various peer machines. The requesting machine is the depicted gaming machine 100, which includes a game controller 802, generally for conducting play of the game. Machine 100 also includes a RNG client and partial RNG 804. This software module may be designed in such a manner as to appear to the game controller as a complete functioning RNG algorithm. Such a design allows RNG client and partial RNG 804 to be provided for use with existing gaming software modules, making them compatible with a networked gaming system using a distributed RNG.

Also shown in FIG. 8 is a peer gaming machine A, which also includes a game controller 802, and a RNG client and partial RNG 805. Both peer gaming machine A and peer gaming machine B cooperate in the depicted block diagram. Peer gaming machine B also includes a gaming controller 802 and a RNG client and partial RNG 806.

The depicted arrows show the passage of data from the various depicted software modules. This scheme is one implementation of the process described with regard to FIG. 4. The depicted RNG client 804, upon requiring a RNG, patches and requests to RNG client 805 on gaming machine A. RNG client and partial RNG 805 then performs the first portion of a linear congruential RNG algorithm calculation, as shown by the block labeled 810. The depicted partial calculation is one example of a way to divide a PRNG algorithm calculation. Once the partial calculation at block numeral 810 is completed, the partial value is forwarded to peer gaming machine B. Notice that the seed, or previous RNG value, is used in the calculation at block 810. The seed therefore is not required to be stored or tracked at RNG client 806.

After receiving the partial value, the RNG client and partial RNG 806 performs the remaining calculations of the linear congruential PRNG algorithm, as shown by block 812. After such calculations, client 806 sends the completed result to the requesting machine 100. Another version of a distributed RNG may provide that peer gaming machine B sends the completed value back to machine A, rather than to the requesting machine.

Figure 9:
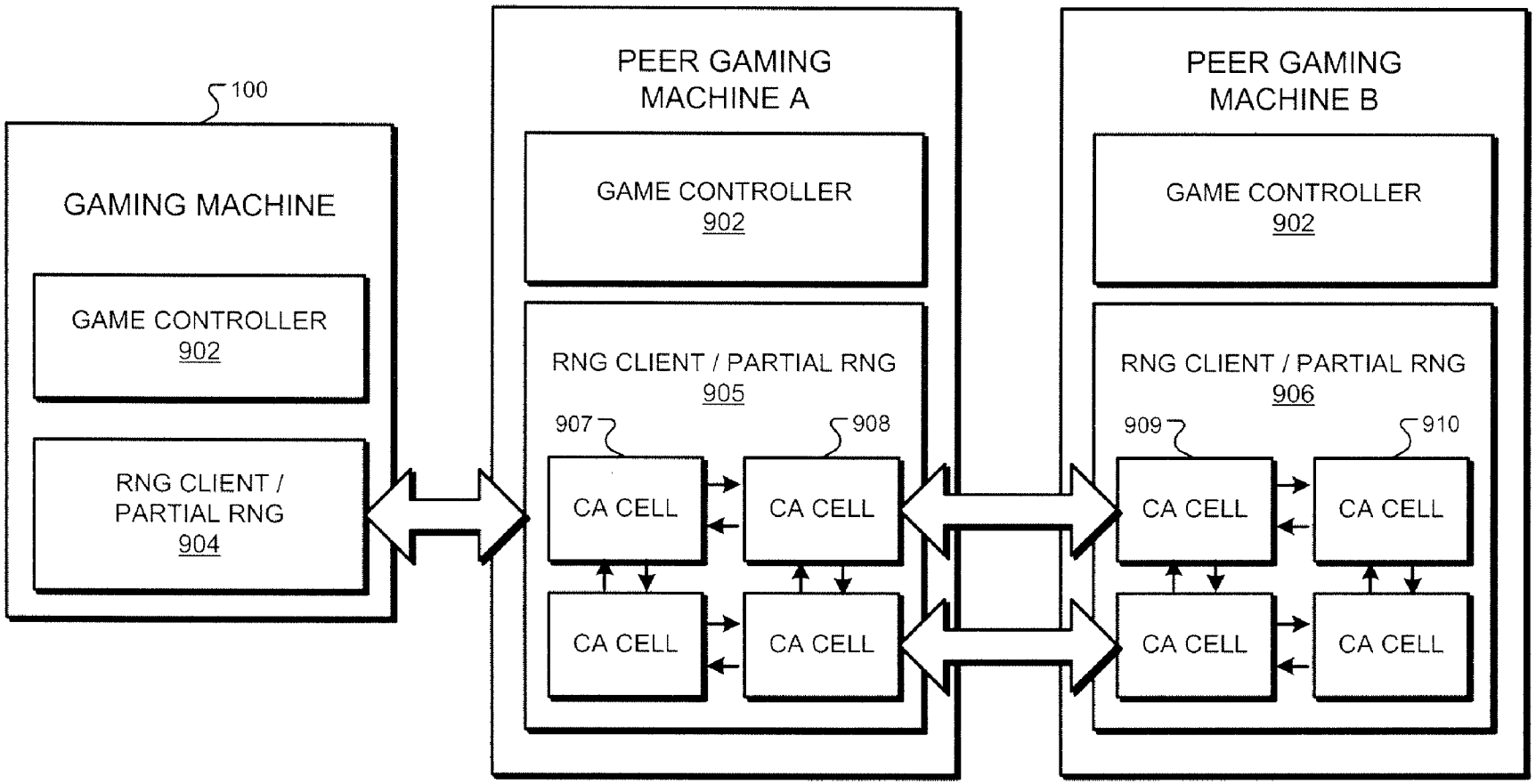
FIG. 9 is another block diagram of a distributed random number generation process generally using a cellular automata (CA) based distributed RNG algorithm.

FIG. 9 is another block diagram of a distributed random number generation process using a cellular automata (CA) based distributed algorithm. This block diagram shows software modules implementing a cellular automata-based RNG. The requesting machine is the depicted gaming machine 100, which includes a game controller 902, generally for conducting play of the game. Machine 100 also includes a RNG client and partial RNG 904. Also shown in FIG. 9 are a peer gaming machine A, and peer gaming machine B, both including a game controller 902 and respective RNG client and partial RNG 905 and 906. Partial RNG's 905 and 906 each include software instantiations of cellular automata of cells as required for use in a CA-based RNG algorithm. The cells are divided amongst machine A and machine B. For example the depicted CA cells 907 and 908 are each part of the same CA-based RNG algorithm as the depicted cells 909 and 910. In a CA-based RNG, the cells pass an output value to other cells, which is used as an input to calculate the output of the other cell. The partial RNG 905 includes cells which pass values to each other. For example cells 907 and 908 are depicted as passing values to each other, as shown by the arrows between the two cells. Cells 909 and 910 cooperate similarly. Also shown is cooperation between cells amongst different machines. An arrow between the two machines connects cells 908 and 909. Other cells similarly interact. Also note that while the depicted CA-based RNG includes eight cells communicating in a defined arrangement, this is not limiting and any suitable CA-based RNG algorithm with varying numbers of cells and interconnections may be used. In the depicted system, communication between RNG clients will also include the final output value of each cell, which may be combined to produce the output random number of the distributed RNG. The combination may of course take place at machine 100 or machine A, or machine B. Preferably, a designated master machine performs a combination step, and also stores the state of the RNG for future repetitions of the algorithm. Such a scheme is further described below.

Figure 10:
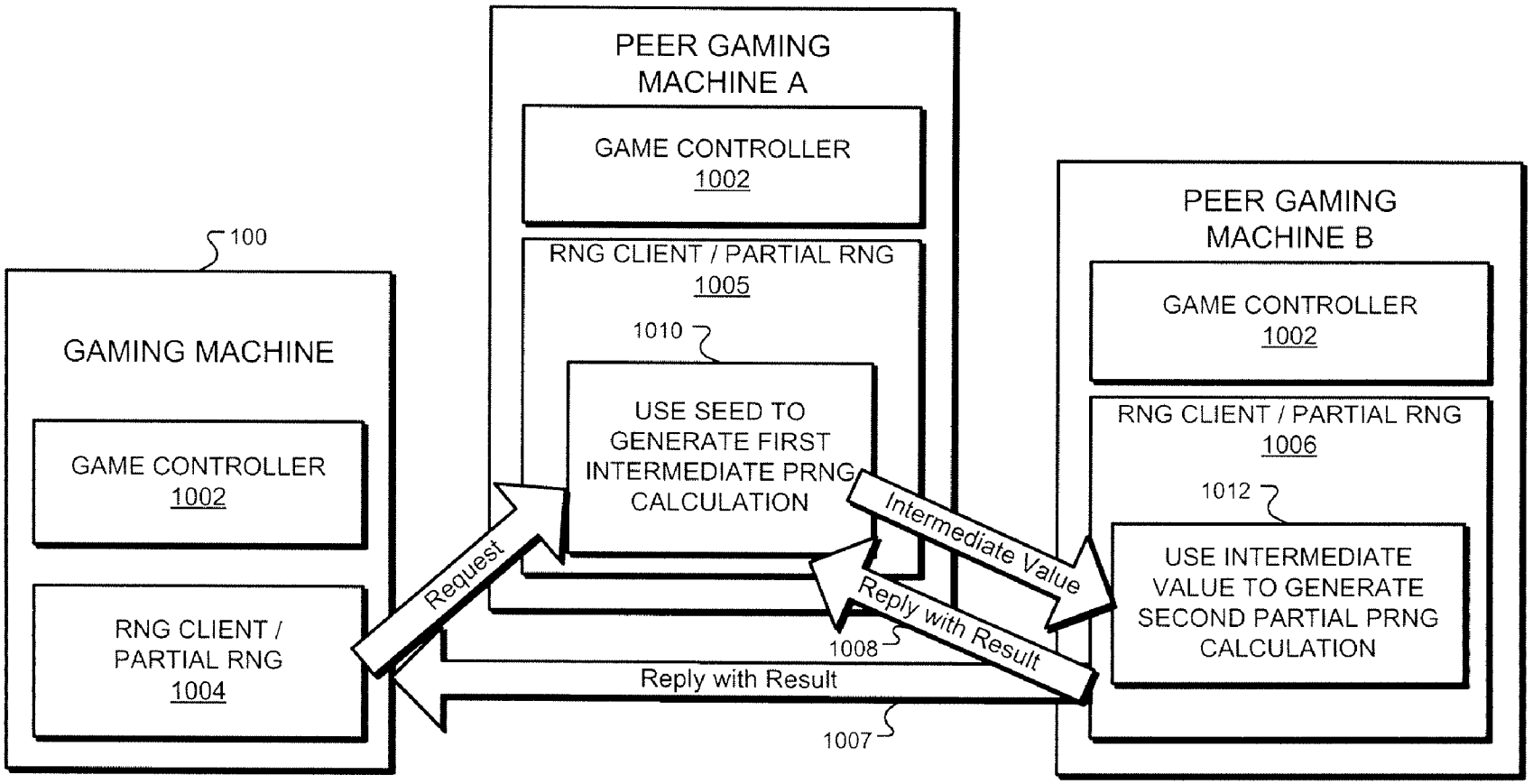
FIG. 10 is another block diagram of a distributed random number generation process generally using an algorithm with a seed.

FIG. 10 is another block diagram of a distributed random number generation process generally using an algorithm with a seed. This block diagram shows software modules for implementing a RNG algorithm, generally of a type in which the RNG stream, or algorithm state, is initiated with a seed. These types of algorithms typically track the state of the RNG by storing the previous output value, and using it in some manner as an input into the next iteration of the RNG calculation. Proper tracking of seeds and the RNG state is essential to the functioning of a RNG algorithm, in achieving its full period and the required random properties associated therewith. The requesting machine again is the depicted gaming machine 100, which includes a game controller 1002, generally for conducting play of the game. Machine 100 also includes a RNG client and partial RNG 1004. Also shown in FIG. 10 are a peer gaming machine A, and peer gaming machine B, both including a game controller 1002 and respective RNG client and partial RNG 1005 and 1006. Each partial RNGs 1005 and 1006 includes a software module, respectively 1010 and 1012, that performs partial RNG calculations. The depicted RNG client and partial RNG 1005 receives a request from the RNG client 1004, and uses a seed value to generate a first intermediate RNG calculation as designated by the software module identified by block 1010. This calculation provides an intermediate value, which is sent to the RNG client and partial RNG 1006. The software module designated at block 1012 uses the received intermediate values to generate a second partial RNG calculation. The result from the calculation at block 1012 is, in most embodiments, an output random number. In the depicted distributed RNG system, this result is sent both to peer gaming machine A at arrow 1008, and to the requesting machine 100 at arrow 1007. This is so that peer gaming machine A may use the result to track the state of the RNG algorithm. (Machine 100 uses the result to affect a game.) Also note that the value may be passed only to machine A, and forwarded from there to machine 100.

While several variations of algorithms are described herein as being distributed among multiple machines, this is not limiting, and any suitable RNG algorithm may be used with the techniques herein. For example, a Mersenne Twister type algorithm may be employed by dividing the algorithm calculations where the "twist" is made, that is the combinatorial function made in the middle of the bank of shift registers, in the preferred Mersenne Twister (using a 624 element array with L=19937, W=32, M=397, and A=X'9908B0DF') starting at element 396, such that one partial calculation includes registers 0 through 396, and includes the combining element 397, and the other partial calculation includes elements 398 through 623. The intermediate value passed in this example case is between registers 398 and 397. Of course, a Mersenne Twister can be divided at other places, and other algorithms may be used according to the principles herein.

Figure 11:
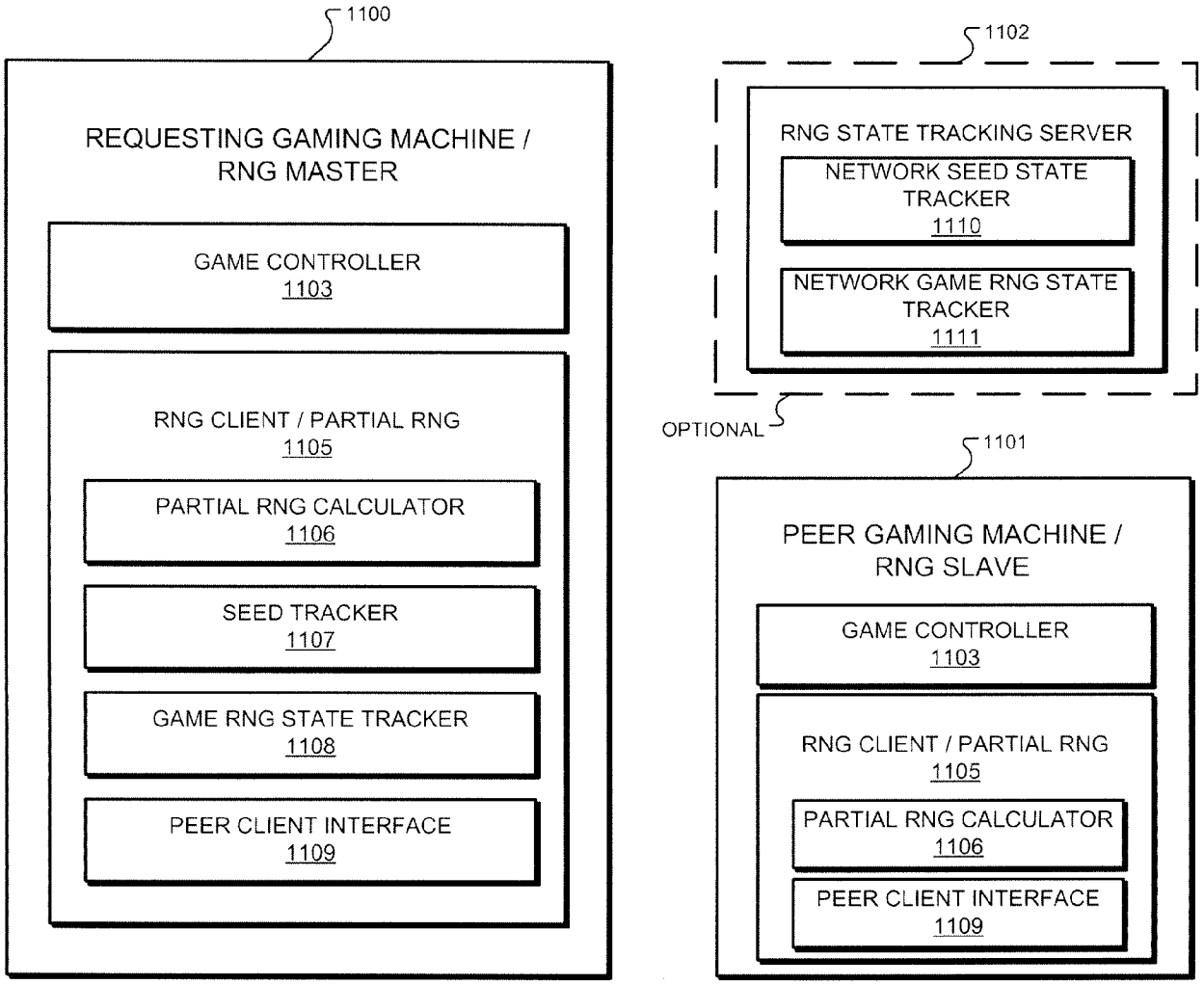
FIG. 11 is a block diagram of a networked gaming system with RNG state tracking on the requesting machine.

FIG. 11 is a block diagram of a networked gaming system with RNG state tracking on the requesting machine. A gaming machine 1100 is, in this embodiment, the requesting gaming machine in the RNG system. (Note that the reference to a particular machine as a "requesting machine" does not mean other machines cannot request RNG's. Preferably all machines are configured to request RNG's. This description merely explains the modules needed to request and respond. In preferred systems, machines include both such modules and so may be requesting machines, master machines, and/or slave machines depending on which machine is the requesting machine.) Machine 1100 includes a game controller 1103, and an RNG client and partial RNG module 1105. Shown in FIG. 11 are various submodules of the RNG client and partial RNG 1105. The module includes a submodule partial RNG calculator 1106, which is a software submodule for performing calculations of a partial RNG algorithm. When a requesting machine is configured to have a partial RNG calculator that performs the first portion of the partial calculation for requests on that machine, the RNG client 1105 forwards RNG requests to partial RNG calculator module 1106, and then facilitates communication with partial RNG clients on one or more other machines to complete the calculation.

Module 1105 also includes a seed tracker software submodule 1107. This submodule is for providing appropriate seed value whenever a RNG algorithm is initiated. In various systems this happens at various times, for example in some systems when the machine is booted each day a new seed is provided. In other systems a fixed number of games or fixed number of RNG's determine when a new seed is provided. Any suitable scheme may be used, which takes into account the repetitive nature of the RNG output when an identical seed is supplied. In some embodiments, the seed tracker 1107 communicates with the depicted RNG state tracking server 1102 in order to receive an appropriate seed value. In some versions, module 1105 may not include a seed tracker, and may instead receive seed values from server 1102.

Also included in module 1105 is a game RNG state tracker 1108. Submodule 1108 is provided for storing the previous value generated from the distributed RNG, and any other variables that may be needed as input to the RNG algorithm for the next round of calculations. For example, in the linear congruential generator version, the only state variable is the previous value of the generator. The other values in the equation are constants that define the generator. Other RNG algorithms may of course require other variables to be stored. Finally, also included in a RNG client and partial RNG 1105 is a peer client interface 1109. This interface handles the communication to the other partial RNG modules on the network. It will interpret incoming requests, send the outgoing requests, and forward tasks to the partial calculator 1109 and other submodules.

Machine 1100 is designated as a master in this embodiment because it is the machine that stores the state of the RNG, controls of the seed, and sends commands to peer machines to complete the RNG process. In this version, the requesting machine is the RNG master machine. Other versions may make another peer machine the RNG master machine.

Also in FIG. 11 is peer machine 1101, which in this version is a RNG slave machine. The machine includes a game controller 1103, and a RNG client and partial RNG 1105. However module 1105 does not include a seed tracker or a game RNG state tracker in this version. Included in module 1105 are a partial RNG calculator submodule 1106 and a peer client interface submodule 1109. The slave machine is so called because it receives requests to perform partial RNG calculations, but does not control the RNG process for the requesting machine 1100, and does not track the state of the RNG algorithm seed or other algorithm state variables.

An RNG state tracking server 1102 is optionally provided in this embodiment, and may be used in other embodiments herein. Server 1102 includes a network seed state tracker 1110 which tracks the states of all (or selected ones) of the seeds in use on RNGs in the network. Seed state tracker 1110 may enforce rules requiring appropriate variety of seeds by tracking the current seed with which each PRNG was initiated, and providing a subsequent seed to initiate each PRNG the next time it is initiated, in keeping with a seed variation algorithm as is known in the art. Server 1102 also includes a network game RNG state tracker 1111, which in some RNG architectures may be combined with the seed state tracker 1110. The RNG state of each RNG on the network is preferably reported to server 1102 as a state variable update message after a PRN is produced. This tracker 1111 may operate as a duplicate state tracker to the state tracker 1108 employed on any RNG master machines such as machine 1100. Such a duplicating function on RNG state tracker 1111 may verify the proper state transitions are made by simulating the entire RNG in parallel to the partial process divided across machines 1100 or 1101 (or any of the other embodiments herein). The state tracker 1111 may also perform backup functions if errors occur at an individual master machine 1100 which cause it to lose track of the RNG state. Such a backup function is equivalent, in some embodiments, to the function of seed state tracking by tracker 1110, because in some PRNG algorithms, the seed and the RNG state are treated equivalently, while in others they are treated differently.

Figure 12:
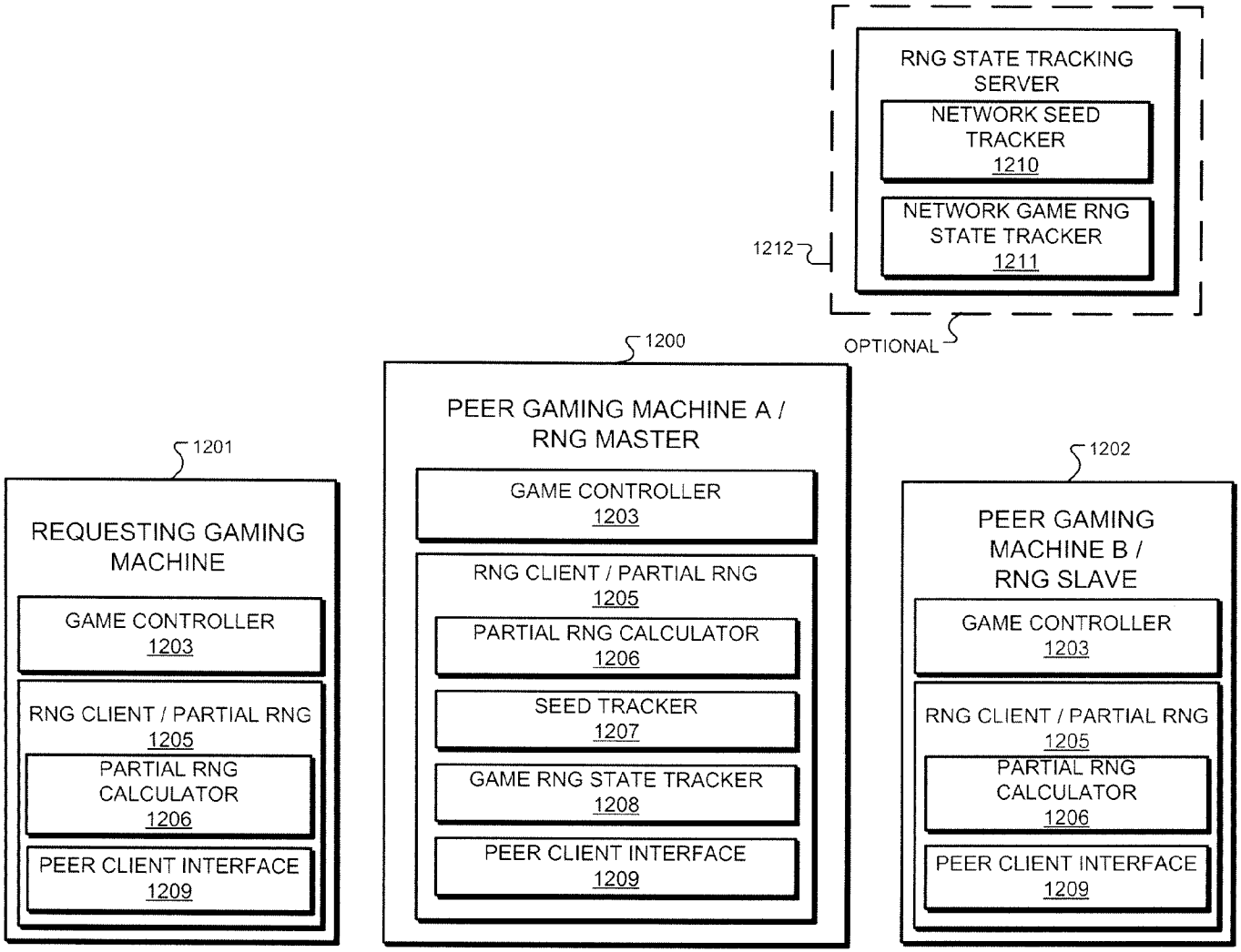
FIG. 12 is a block diagram of a networked gaming system with RNG state tracking on a peer machine.

FIG. 12 is a block diagram of a networked gaming system with RNG state tracking on a peer machine. This system is similar to that in FIG. 11, except that the requesting gaming machine 1201 does not include the RNG master. Instead a peer gaming machine 1200 acts as the RNG master. In use, the requesting machine 1201 is configured to send requests to machine 1200, which is the RNG master, and manages the distributed process and returns the completed result to requesting machine 1201. Note that another peer machine 1202 may act as a slave to machine 1200. The game controller 1203, RNG client/partial RNG 1205, partial RNG calculator 1206, seed tracker 1207, game state tracker 1208, and peer client interface 1209 all have similar functions to those (1103-1109) described with respect to FIG. 11, with the difference being the requesting machine 1201 does not act as the RNG master. The peer machine A/RNG master machine 1200 receives the RNG request from requesting machine 1201 and produces the RNG as described herein by requesting a partial calculation from peer gaming machine B/RNG slave 1202. The calculation may proceed, for example, by the processes described with respect to FIG. 8, FIG. 9, or FIG. 10.

Also shown in FIG. 12, is an optional RNG state tracking server 1212, which is similar to server 1102 in FIG. 11. Server 1212 may distribute and manage the use of algorithm seeds for all machines on the network. A networked seed tracker 1210 is provided to ensure proper distribution of seeds throughout the network. Seed management among multiple RNG's is known in the art and will not be further described here. One goal of seed management is to make sure that all RNG algorithms have sufficient variation in their seed values being far apart in the RNG algorithm period. In some embodiments, the state tracking information for a RNG master, such as machine 1200, or a RNG slave, such as machine 1202, may not be tracked on master machine 1200, but instead may be tracked by the network game RNG state tracker 1211.

Figure 13:
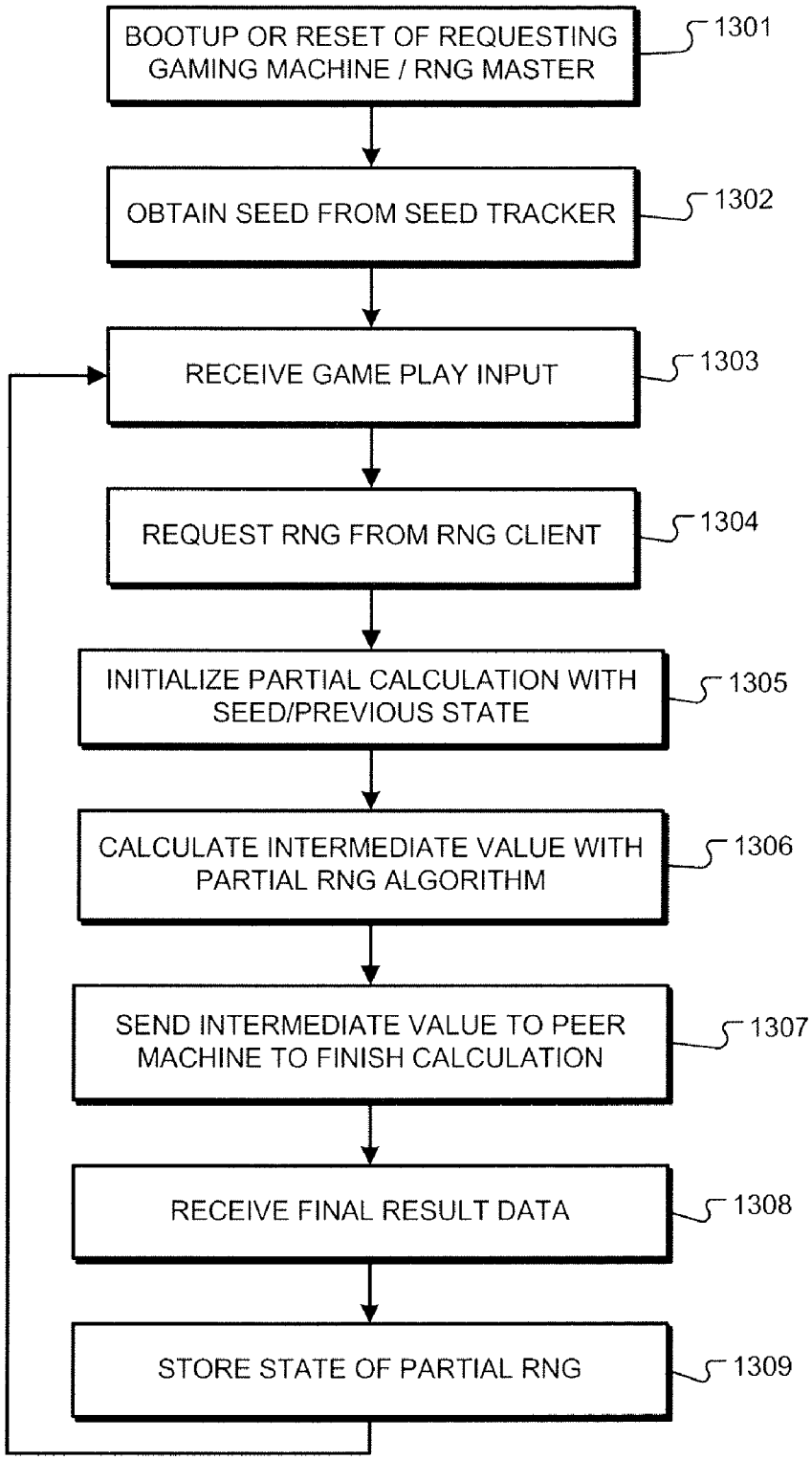
FIG. 13 is a flow chart of a requesting gaming machine operation process according to one embodiment.

FIG. 13 is a flow chart of a requesting gaming machine operation process according to one embodiment. The process begins at step 1301 with a bootup of a machine, or the resetting of gaming machine or a RNG client which acts as a master. Next at step 1302, the RNG client obtains a seed from the seed tracker module. The module may be part of the client, or may be running on a seed tracking server as previously described. Next at step 1303, a gaming machine receives a game play input such as an wager activation. When a random number is needed in the game, the game requests an RNG from the RNG client at step 1304. Notice that steps 1303 and 1304, in this version, occur on the same machine running the RNG client that acts as a master (the arrangement of FIG. 11). The RNG client, running on the same machine, receives the request at step 1304, and in response initializes the partial calculation with the seed value at step 1305. When an algorithm has already been seeded and used, previous state information is used instead of the seed value.

Next at step 1306, the partial RNG calculator submodule calculates an intermediate value using the partial RNG algorithm. This value is sent to a peer machine to finish the calculation at step 1307. The requesting machine receives the final result data step at 1308. Preferred versions passed the data through the master machine, which is responsible for managing fulfilling a particular request from a requesting machine. In other embodiments, the request data may be passed through from the master to the slave machine with the message sent at step 1307, and the slave machine will forward the final result directly to the requesting machine. In either case, the final result is also sent to the machine acting as a RNG master. This machine will store the current state information needed to capture the state of the RNG algorithm, and thereby ensure that the algorithm proceeds properly through its period, maintaining the appropriate random properties of the distributed algorithm output, at step 1309.

Figure 14:
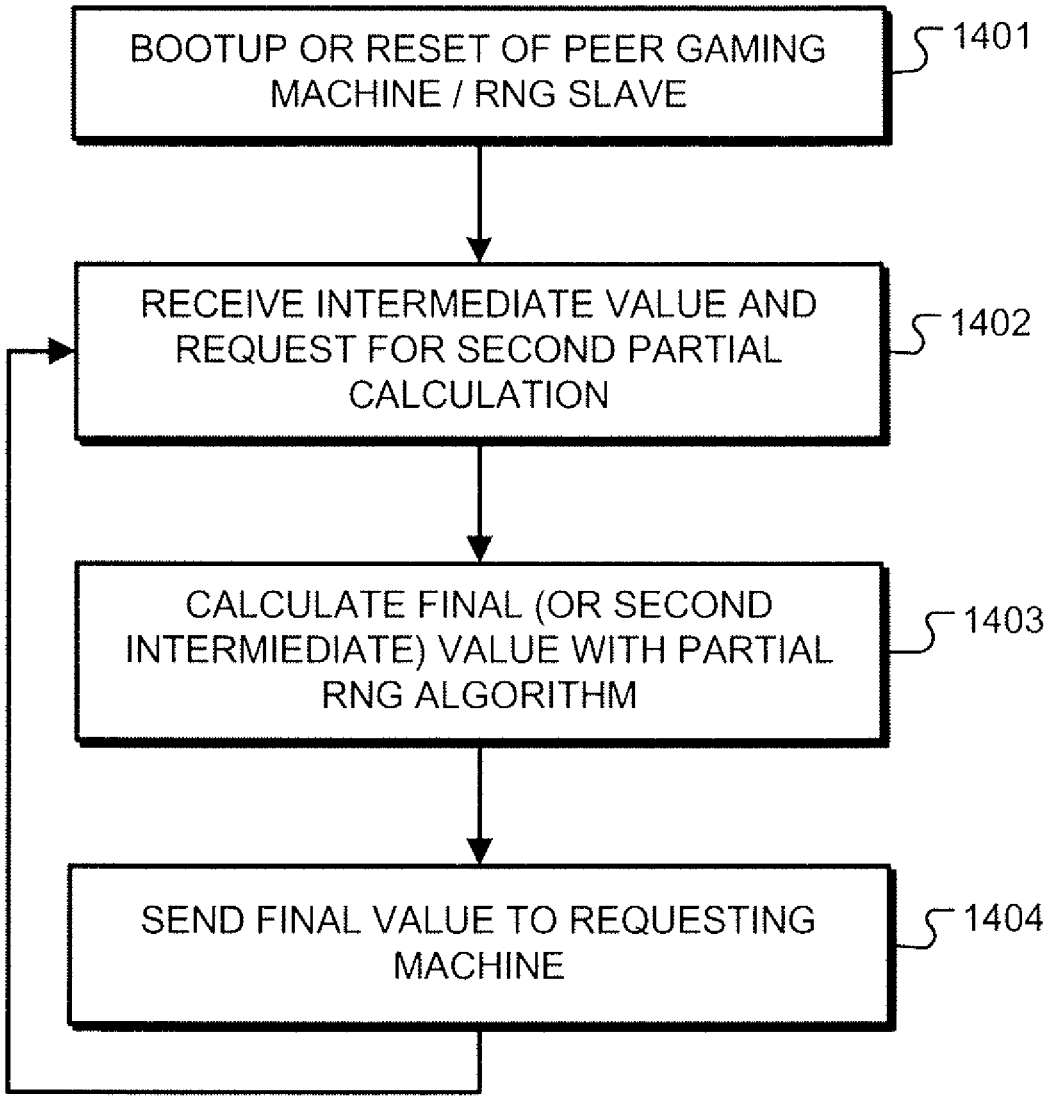
FIG. 14 is a flow chart of a peer gaming machine operation process according to one embodiment.

FIG. 14 is a flow chart of a peer gaming machine operation process according to one embodiment, for a peer gaming machine configured as a RNG slave. In step 1401, the slave machine is rebooted or otherwise reset. This machine requires no seed tracking or RNG state tracking to initialize the partial RNG algorithm. When a RNG client on a master slave machine sends a request for this machine to complete a distributed RNG calculation (step 1402), the machine receives the request along with the intermediate result needed to start the calculation. At step 1403, the slave machine calculates the final value of the distributed RNG. If more than two machines cooperate in the calculation, this step would calculate a second intermediate value. However, preferred embodiments require only two machines to cooperate in the distributed RNG calculation. Finally, at step 1404, the process sends the final value to RNG client of the requesting machine, and to the RNG client of the master machine that requested the calculation. The process then loops back to step 1402 to wait for a new request.

Figure 15:
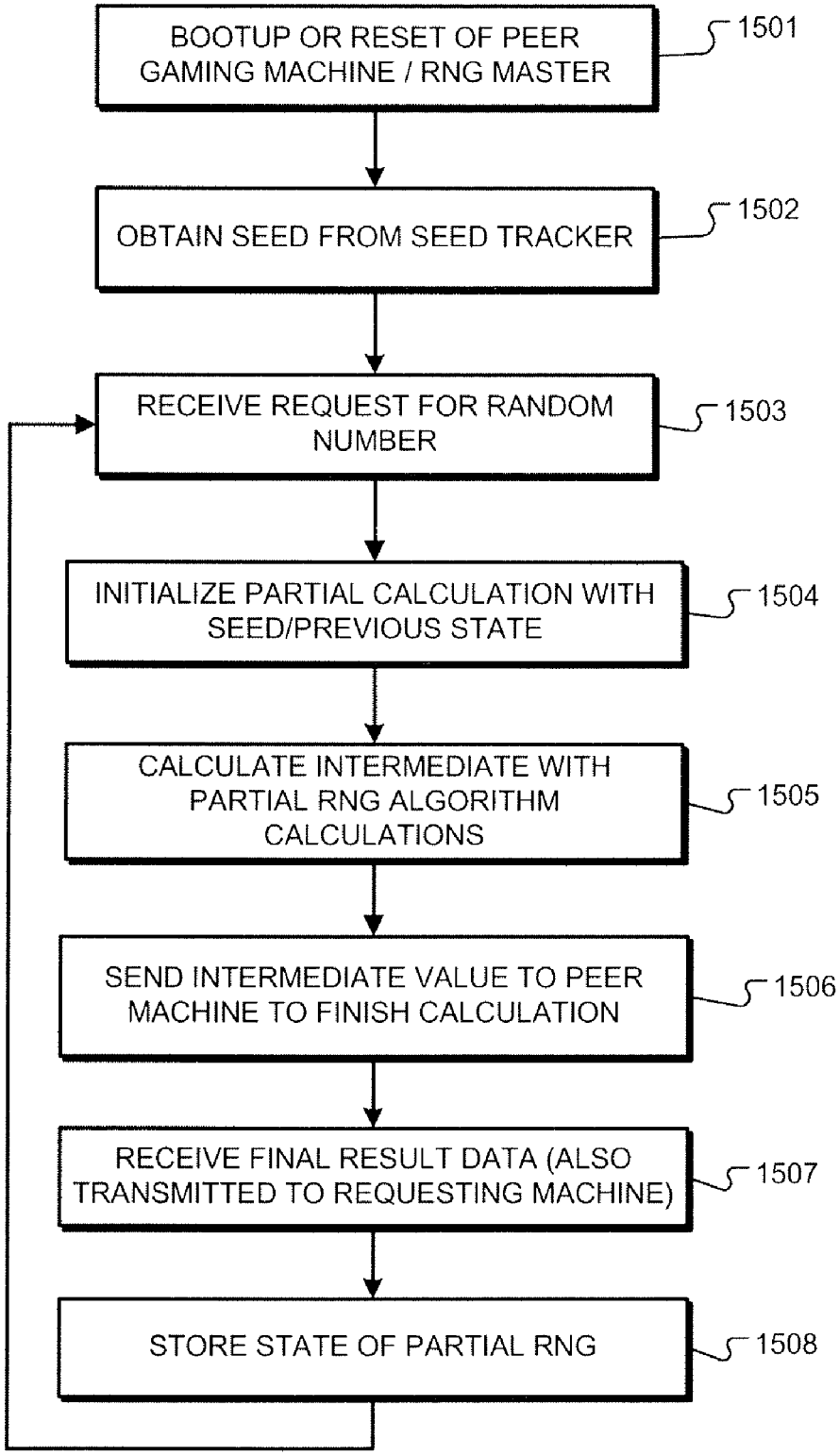
FIG. 15 is a flow chart of a peer gaming machine operation process according to another embodiment.

FIG. 15 is a flow chart of a peer gaming machine operation process according to another embodiment. In this embodiment, the RNG client acting as a RNG master is not on the requesting machine, but instead is on a peer machine. The process begins at step 1501 with a bootup of a machine, or the resetting of gaming machine or a RNG client which acts as a master. Next at step 1502, the RNG client obtains a seed from the seed tracker module. At this point the RNG client and partial RNG calculator is ready and waiting to receive RNG requests from other machines. At step 1503, the machine receives a RNG request from a peer machine. The RNG client receives the request and in response initializes the partial calculation with the seed value at step 1504. When an algorithm has already been seeded and used, previous state information is used instead of the seed value.

Next at step 1505, the partial RNG calculator submodule calculates an intermediate value using the partial RNG algorithm. This value is sent to a peer machine to finish the calculation at step 1506. The RNG master machine receives the final resulting data at step 1507, and stores the current state information needed to capture the state of the RNG algorithm at step 1508. The process then returns to step 1503 to wait for further requests.

FIG. 16A is a diagram of a data structure for requesting distributed generation of a RNG according to one embodiment. This is merely one example of a data structure, and any suitable format may be used. A preferred version uses XML tags to identify the various data fields, and the data is transmitted in encrypted IP packets over connections maintained by the various RNG client modules. The depicted requests data object includes a Requesting Machine field, which contains an identifier for the machine requesting the random number, and serves to indicate where the random number will be sent when the various partial calculations are complete. The next field is a Sending Machine field, which identifies the message machine transmitting this particular data object. Notice that this will be the same as the requesting machine for the first request sent to a peer machine. However, the first peer machine may forward another request for a partial calculation by a second peer machine, in which case this field will contain an identifier for the first peer machine. A Game ID field in the data object contains an identifier of the particular game for which a random number is required. A Record ID field is used to indicate an identifier for the particular game play using the requested random number. In various embodiments, the Record ID may be an identifier for a predetermined record used in an electronic lotto ticket-type game, or maybe an identifier for a bingo card played in a network bingo game, or may be an identifier generated to record a particular slot-style game round.

The next field is a RNG ID, which identifies the type of RNG required by the game. This identifier may further be used to identify not only a particular type of algorithm, but also a specific RNG identified not only by an algorithm, but all of the constants and other configuration data needed to identify a specific instantiation of the algorithm. For example in a linear congruential algorithm, a particular value of the identifier would identify the RNG not only as a linear congruential RNG, but also identify the RNG specifically enough to provide the value for the constants a, c, and m used in the equation. In other embodiments these constants may be included directly in the message, but preferably all of the qualified RNG algorithms allowed to run on the network are referred to by an identifier value.

A RNG stage field may be included to identify which stage of the multi-part RNG calculation is required. For example, in the original request, before any RNG calculation has been performed, this field would identify the first stage. When a request is sent from the peer machine making the first partial calculation, this field would identify the second stage. This field may also serve to identify the cell from which a value is output in CA-based versions. Further, the field may identify a shift register position in versions using a shift-register based PRNG algorithm. The RNG stage field, together with the Value field following it, may repeat many times to transmit multiple values with the same message.

The Value field contains the partial value calculated at the previous stage of the distributed algorithm (for example, the intermediate value transmitted as shown in FIG. 10). Note that other fields may be added to transmit other data values, this is merely one example. Finally, a Timestamp field is included for tracking purposes.

The depicted data structure describes the message structure sent between RNG clients in one embodiment to accomplish the distributed RNG calculation. Other messaging such as security and encryption messaging will also be exchanged, of course, but is beyond the scope of this disclosure.

FIG. 16B is a diagram of a data structure for storing a partial RNG state according to one embodiment. This data structure may be sent in a message between peer machines to track the RNG state for a particular RNG, or may be sent to a server for the same purpose. Also, the data will preferably be stored at the RNG client master for each RNG present on the machine.

The data structure includes a RNG ID to identify the RNG for which state data is stored. In this example, the state data is comprised of the Previous $X_n$, which captures the RNG state for certain algorithms. The state data structure also includes a Previous Record ID field containing an identifier of the previous game round (the round in which the previous $X_n$ was used). Another field labeled State Info may contain other information regarding the RNG state. Similar fields may be included and may use different names such as Cell Number (identifying a cell in a CA-based distributed RNG) or any other data needed to completely capture the state of the distributed RNG calculator. A Timestamp field is also included in this data structure for tracking purposes.

Note while some preferred embodiments have been described herein, many other embodiments are possible within the scope of the invention. For example, while peer machines are taught herein, a server may be used to perform part of the distributed RNG calculation. For example, in the process shown in FIG. 5, the second machine may be a partial RNG server containing a RNG software module for performing the partial RNG calculations as described herein. Yet another possible embodiment provides that the requesting machine sends the initial RNG request to a partial RNG server, which performs the first portion of RNG calculation (such as, for example, 810 in FIG. 8), and then sends the partial value back to the requesting machine to finish the calculation. (In the same example, calculations 812 in FIG. 8 would be performed at the requesting machine.)

Also notice that as used herein, calculating a seed value is not considered to be part of the RNG calculations, and is not by itself a "partial RNG calculation." Nor is a seed value considered an "intermediate value" or partial value/result as used herein. Calculating seeds at a seed server is known in the art and is not further described herein.

As used herein, the terms "comprising," "including," "carrying," "having," "containing," "involving," and the like are to be understood to be open-ended, that is, to mean including but not limited to.

Any use of ordinal terms such as "first," "second," "third," etc., to refer to an element does not by itself connote any priority, precedence, or order of one element over another, or the temporal order in which acts of a method are performed. Rather, unless specifically stated otherwise, such ordinal terms are used merely as labels to distinguish one element having a certain name from another element having a same name (but for use of the ordinal term).

The above described preferred embodiments are intended to illustrate the principles of the invention, but not to limit the scope of the invention. Various other embodiments and modifications to these preferred embodiments may be made by those skilled in the art without departing from the scope of the present invention.

The invention claimed is:

1. A method comprising:

calculating, at a first one of multiple peer machines on a gaming network, a first partial calculation of a pseudo-random number generating algorithm, the first partial calculation including a use of a seed value to calculate at least one intermediate value;

transmitting a first result of the first partial calculation to a second one of the multiple peer machines;

calculating, at the second one of the multiple peer machines, a second partial calculation of the pseudo-random number generating algorithm and transmitting a second result of the second partial calculation to a requesting machine;

combining results of the two partial calculations of the pseudo-random number generating algorithm to generate a random number;

using the random number to affect a game outcome; and causing the game outcome to be conveyed to a player.

2. The method of claim 1 in which the second partial calculation further comprises use of a second seed value.

3. The method of claim 1 in which the first partial calculation comprises calculating outputs of one or more cellular automata-based random number generator (RNG) cells.

4. The method of claim 2 in which the first partial calculation further comprises receiving a seed value and initiating the first partial calculation of the pseudo-random number generating algorithm using the seed value.

5. The method of claim 1 in which the random number affects the game by identifying a graphic element to convey the game outcome.

6. The method of claim 1 further comprising storing state information for a partial random number generator (RNG) calculator.

7. A method comprising:

transmitting a request for a random number to one or more of multiple peer machines on a gaming network;

calculating, at a first one of the multiple peer machines, a first partial calculation of a pseudo-random number generating algorithm and transmitting a first result of the first partial calculation to a second one of the multiple peer machines;

calculating, at the second one of the multiple peer machines, a second partial calculation of the pseudo-random number generating algorithm and transmitting a second result of the second partial calculation to a requesting machine;

combining results of the two partial calculations of the pseudo-random number generating algorithm to generate the random number; and using the random number, identifying a game outcome in a game outcome table;

causing the game outcome to be displayed to a player.

8. The method of claim 7 wherein the first partial calculation includes calculating employing a seed value, the seed value tracked by a seed tracking software module on the first peer machine.

9. The method of claim 7 wherein the first partial calculation includes using previous random number generator (RNG) state data, the previous RNG state data tracked by a RNG state tracking software module on the first one of the multiple peer machines.

10. The method of claim 7 wherein the first partial calculation includes calculating an output for a cellular automata (CA)-based random number generator cell.

11. The method of claim 7 further comprising storing state information for a partial random number generator (RNG) calculator.

12. A gaming system comprising:

a display device arrangement on a gaming machine;

a player input device arrangement on the gaming machine;

a game controller for responding to a game activation at the player input device arrangement to display a game result to a player at the display device arrangement; and a random number generator (RNG) client software module running on the gaming machine for providing RNG values to the game controller, the RNG client software module further for communicating with a selected first partial RNG calculator module running on the gaming machine, or on a first networked machine, the selected first partial RNG calculator module operable to calculate an intermediate value for a random number generator algorithm and then communicate the intermediate value to a selected second partial RNG calculator module running on the gaming machine, the first networked machine, or a second networked machine, but not on the same gaming machine as the selected first partial RNG calculator module.

13. The gaming system of claim 12 wherein the selected second partial RNG calculator module is further operable to send a completed partial RNG calculation value to the gaming machine.

14. The gaming system of claim 12 wherein the selected second partial RNG calculator module is further operable to send a completed partial RNG calculation value to a RNG client controlling the selected first partial RNG calculator module.

15. The gaming system of claim 12 wherein the selected second partial RNG calculator module is further operable to exchange a second intermediate RNG calculation value with the selected first partial RNG calculator module.

16. The gaming system of claim 12 wherein the selected first partial RNG calculator module is further operable to use previous RNG state data, the previous RNG state data tracked by a RNG state tracking software module on the gaming machine with the selected first partial RNG calculator module.

17. The gaming system of claim 12 further comprising a RNG state tracking software module installed on the gaming machine or on the first networked machine, and executable track to state information for a partial RNG calculator.

18. A program product embodied in one or more non-transitory computer readable media, the program product including:

first game program code executable to respond to a game activation input and operate a game play round;

game display program code executable to display results of the game play round to a player; and random number generator (RNG) client program code executable to provide RNG values to the first game program code, the RNG client program code further executable for communicating with a selected first partial RNG calculator program code running on a requesting gaming machine, or on a first networked machine, the selected first partial RNG calculator program code executable to calculate an intermediate value for a random number generator algorithm and then communicate the intermediate value to a selected second partial RNG calculator program code running on the gaming machine, the first networked machine, or a second networked machine, but not on the same gaming machine as the selected first partial RNG calculator program code.

19. The program product of claim 18 wherein the selected second partial RNG calculator program code is further executable to send a completed partial RNG calculation value to the requesting gaming machine.

20. The program product of claim 18 wherein the selected second partial RNG calculator program code is further executable to exchange a second intermediate RNG calculation value with the selected first partial RNG calculator program code.

21. The program product of claim 18 wherein the selected first partial RNG calculator program code is further operable to use previous RNG state data, the previous RNG state data tracked by a RNG state tracking software module on a host machine of the first partial RNG calculator program code.

* * * * *